US007678518B2

(12) United States Patent
Yagi et al.

(10) Patent No.: US 7,678,518 B2
(45) Date of Patent: Mar. 16, 2010

(54) ELECTROPHOTOGRAPHIC PHOTORECEPTOR, AND PROCESS CARTRIDGE AND IMAGE-FORMING APPARATUS USING THE SAME

(75) Inventors: Shigeru Yagi, Kanagawa (JP); Takeshi Iwanaga, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 473 days.

(21) Appl. No.: 11/702,682

(22) Filed: Feb. 6, 2007

(65) Prior Publication Data

US 2008/0070138 A1 Mar. 20, 2008

(30) Foreign Application Priority Data

Sep. 19, 2006 (JP) ..... 2006-253010
Sep. 22, 2006 (JP) ..... 2006-257675

(51) Int. Cl.
*G03G 15/04* (2006.01)

(52) U.S. Cl. ..... 430/66; 399/159

(58) Field of Classification Search ..... 430/66; 399/159

See application file for complete search history.

(56) References Cited

U.S. PATENT DOCUMENTS

| | | | | |
|---|---|---|---|---|
| 4,737,429 | A * | 4/1988 | Mort et al. | 430/57.5 |
| 5,834,147 | A * | 11/1998 | Nagae et al. | 430/67 |
| 6,372,397 | B1 * | 4/2002 | Maruyama et al. | 430/59.6 |
| 2002/0051918 | A1 * | 5/2002 | Miyamoto et al. | 430/58.65 |

FOREIGN PATENT DOCUMENTS

| | | |
|---|---|---|
| JP | A 2-110470 | 4/1990 |
| JP | A 11-186571 | 7/1999 |
| JP | A 2003-27238 | 1/2003 |
| JP | A 2003-29437 | 1/2003 |
| JP | A 2003-316053 | 11/2003 |

* cited by examiner

*Primary Examiner*—Mark A Chapman
(74) *Attorney, Agent, or Firm*—Oliff & Berridge, PLC

(57) ABSTRACT

An electrophotographic photoreceptor including a conductive substrate, and a photosensitive layer, an intermediate layer, and a surface layer formed thereon in this order, wherein the surface layer contains a Group 13 element and at least one of nitrogen or oxygen.

12 Claims, 7 Drawing Sheets

ELECTROPHOTOGRAPHIC PHOTORECEPTOR, AND PROCESS CARTRIDGE AND IMAGE-FORMING APPARATUS USING THE SAME

CROSS-REFERENCE TO RELATED APPLICATIONS

This application is based on and claims priority under 35 USC 119 from Japanese Patent Applications No. 2006-253010 filed on Sep. 19, 2006 and No. 2006-257675 filed on Sep. 22, 2006.

BACKGROUND

1. Technical Field

The invention relates to an electrophotographic photoreceptor for use in devices forming an image by an electrophotographic method, such as copying machine, and a process cartridge and an image-forming apparatus using the electrophotographic photoreceptor.

2. Related Art

Recently, the electrophotographic method has been used widely, for example, in copying machines, printers, and the like. An electrophotographic photoreceptor for use in image-forming apparatuses utilizing the electrophotographic method (hereinafter, sometimes referred to as a "photoreceptor") comes into contact with various materials and is exposed to various stresses in the apparatus and thus deteriorates gradually. However, on the other hand, it should also cope with the demand for digitalization and colorization of image-forming apparatuses and high reliability.

For example, the process of charging the photoreceptor involves the following problems. First, in the non-contact charging mode, discharge products deposit on the photoreceptor, causing problems such as image blurring. For this reason, for example, a system in which particles functioning as a polishing agent are added to the developer and the developer is removed in a cleaning unit is used in some cases for removal of the discharge products deposited on the photoreceptor. In such a case, the surface of the photoreceptor deteriorates gradually due to abrasion. On the other hand, systems utilizing the contact charging mode have been used widely recently. In this mode as well, the abrasion of the photoreceptor may be accelerated.

Under the circumstances above, there exists a need for prolongation of the life of the electrophotographic photoreceptor. Prolongation of the life of electrophotographic photoreceptor requires improvement in abrasion resistance and thus an increase in the hardness of the photoreceptor surface.

However, in a photoreceptor made of amorphous silicon having a surface of high-hardness, discharge products and the like deposit thereon often causing image blurring and image deformation, and this phenomenon is more distinctive, especially under high-humidity conditions. The same is true for the surface layer of an organic photoreceptor having an organic photosensitive layer.

For prevention of the problems mentioned above, carbon-based materials are often used as the surface layer of the photoreceptor.

However, improvement in film hardness of a carbon-based film, such as a hydrogenated amorphous carbon film (a-C:H) or a fluorinated film thereof (a-C:H,F), leads to color development of the film. Thus, abrasion of the surface layer of the carbon-based film leads to an increase in light transmission efficiency of the surface layer over time, causing a problem of an increase in sensitivity of the photosensitive layer below the surface layer. In addition, uneven abrasion of the surface layer in the surface direction also leads to uneven distribution of the sensitivity of the photosensitive-layer, causing a problem of image irregularity, especially when a halftone image is formed.

On the other hand, improvement in hardness and improvement in transparency are known to have a trade off relationship, as a general characteristic of carbon-based thin film materials. This is because, as for the carbon bond in the film, it is necessary to increase the rate of diamond-type $sp^3$ bonding for improvement in hardness, while these films inevitably have graphite-type $sp^2$ bonding causing light absorption, and reduction in the rate of the graphite-type $sp^2$ bonding in the film by hydrogenation or the like results in improvement in transparency but also deterioration in hardness, as the film becomes more organic.

Research and development of carbon nitride film is in progress recently, but the film is still not better in hardness and other properties than conventional carbon-based thin films such as diamond film and diamond-type carbon film. The harder and denser film also requires heating at a temperature of around 1,000° C. and larger discharge power during deposition. However, application of such a method of forming a film at high temperature under high-energy discharge conditions particularly to organic photoreceptors that are vulnerable to heat and discharge is difficult, and thus, the method is impractical.

Accordingly, conventional carbon-based thin films are still insufficient as the surface layer of a photoreceptor, from the points of both hardness and transparency. On the other hand, hydrogenated amorphous silicon carbide films (a-SiC:H) are superior concerning this point. However, such a film often causes image blurring and image deformation due to deposition of discharge products or the like, and thus, it is necessary to use a drum heater for prevention of these problems. In addition, although hydrogenated nitride semiconductors are superior in hardness and transparency, they are also inferior in water resistance and practicability in a high-humidity environment.

In addition to the methods of forming a surface layer in a gas phase described above, methods of forming a surface layer by coating have been proposed. Among them, for improvement in abrasion resistance, use of a polymer compound having siloxane bonds in the surface layer is known. However, a surface layer of such a material is softer than the surface layer formed in a gas phase. Thus, the surface adhesiveness of the layer gradually increases over time, when subjected to abration after damage occurs on the photoreceptor surface, causing the problem of adhesion of toner on the photoreceptor surface resulting in shortening of the life of the photoreceptor.

SUMMARY

According to an aspect of the present invention, there is provided an electrophotographic photoreceptor comprising a conductive substrate, and a photosensitive layer, an intermediate layer, and a surface layer formed thereon in this order, and the surface layer containing a Group 13 element and at least one of nitrogen or oxygen.

BRIEF DESCRIPTION OF THE DRAWINGS

Exemplary embodiments of the invention will be described in detail based on the following figures, wherein.

DETAILED DESCRIPTION

Figure 1:
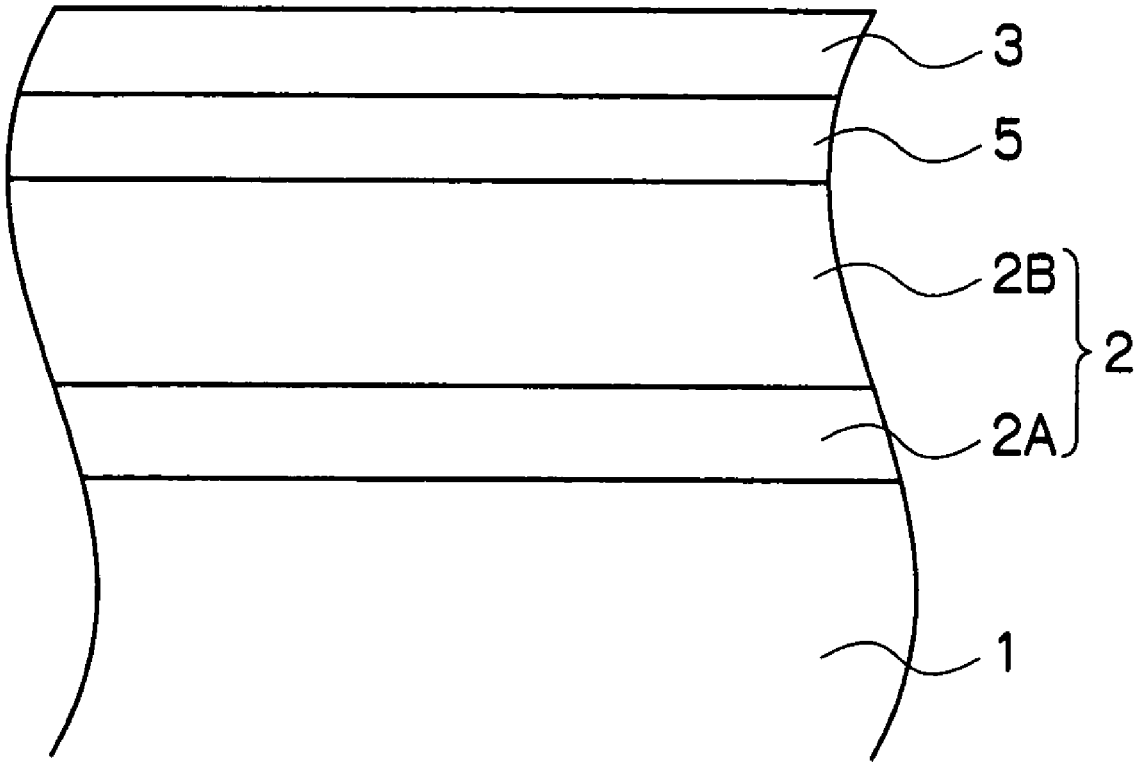
FIG. 1 is a schematic sectional view illustrating an example of the photoreceptor of the present invention.

The electrophotographic photoreceptor of the present invention (hereinafter, abbreviated as a "photoreceptor" in some cases) is an electrophotographic photoreceptor comprising a conductive substrate, and a photosensitive layer, an intermediate layer, and a surface layer formed thereon in this order, wherein the surface layer contains a Group 13 element and at least nitrogen or oxygen.

The Group 13 element contained in the surface layer, and nitrogen and/or oxygen constitute a nitride or oxide semiconductor compound superior in hardness and transparency. Specifically, the photoreceptor of the invention is less frictional against sliding and highly water-repellent, thus superior in surface-abrasion resistance, resistant to scratching, and favorably sensitive.

The photoreceptor surface itself is also resistant to oxidation (oxidation resistance) under oxidative atmosphere such as of ozone, nitrogen oxide and others generated by a charger in image-forming apparatus and prevents oxidative degradation of photoreceptor, and in particular, when the surface layer is made of an oxide semiconductor compound of Group 13 element, the photoreceptor surface is more resistant to oxidation. In addition, it is possible to reduce deposition of discharge products on the surface layer and thus reduce generation of image defect.

It is also possible to reduce the mechanical stress caused by the difference in hardness and thermal expansion coefficient between the surface layer and the photosensitive layer and obtain favorable mechanical durability, by forming an intermediate layer between the surface layer and the photosensitive layer. In conventional photoreceptors having an extremely thick surface layer, there are many fine cracks and defects in the surface layer formed by the internal stress present immediately after photosensitive layer formation and also by the mechanical stimuli by cleaner system, paper, transfer mechanism, and others cumulatively applied during print output, causing deterioration of the electric charge-transporting property, uneven transportation, and hence uneven image density. However, it is possible to prevent cracks and defects by forming an intermediate layer in the photoreceptor of the invention. Thus, it is possible to provide a photoreceptor retaining high quality for an extended period of time.

Presence of the intermediate layer is effective in preventing the fatigue of charge-transporting layer (phenomenon of charge-transporting material molecule in charge-transporting layer becoming conductive by excitation and ionization), for example, by plasma electron and ion exposure or UV irradiation during formation of the surface layer in the production process. Further in the step when the photoreceptor is placed in the image-forming apparatus, it is possible to prevent corona discharge on the photoreceptor surface and irradiation of short-wavelength light such as ultraviolet ray onto the photosensitive layer from various light sources and also fatigue and deterioration of the charge-transporting layer, and thus to keep the photoreceptor favorably sensitive for an extended period of time.

In combination of these effects, it is possible to provide an electrophotographic photoreceptor superior in surface mechanical durability and oxidation resistance, resistant to image defect by deposition of discharge products, higher in sensitivity, lower in friction to sliding, and highly water-repellent that retains these properties easily at a high level over time.

The electrophotographic photoreceptor in another embodiment of the invention comprises a conductive substrate, and a photosensitive layer, an intermediate layer, and a surface layer formed thereon in this order, wherein both the intermediate layer and the surface layer contain a Group 13 element and at least one of oxygen or nitrogen, and the composition ratio of the elements in the intermediate layer and the surface layer are different from each other.

The surface layer of the photoreceptor in an embodiment of the invention containing oxide or nitride of a Group 13 element is resistant to oxidation in the oxidative atmosphere containing ozone, nitrogen oxide, and others generated by a charger in an image-forming apparatus, and thus the photoreceptor is resistant to degradation by oxidation. As described above, the photoreceptor is also superior in mechanical durability and oxidation resistance and retains these properties easily at a high level for an extended period of time. The photoreceptor surface, which is exposed to abrasion for example by cleaning blade, is superior in abrasion resistance, and resistant to scratching on the photoreceptor surface, and thus, it is possible to give the photoreceptor favorable sensitivity easily.

However, the surface layer is made of a hard inorganic thin film, and thus, especially when the photosensitive layer is made of an organic material, the coefficients of thermal expansion and the distortion characteristics against stress differs significantly from each other between the photosensitive layer and the surface layer, occasionally causing mechanical stress between the layers. Increase in layer thickness for improvement in mechanical properties results in increase in residual electric potential and deterioration in electric properties, causing problems for example in image density and uniformity.

After intensive studies to solve the problems above, the inventors have found that it is possible to solve the problem by forming an intermediate layer containing the elements similar to those in the surface layer but different in kind and composition, between the surface layer and the photosensitive layer.

Specifically, because the intermediate layer in the embodiment of the invention contains the Group 13 element and at least one of oxygen or nitrogen contained in the surface layer similarly as will be described below, adhesiveness between the intermediate layer and the surface layer is favorable, and it is possible to make the thermal expansion coefficient and elastic modulus of the intermediate layer more similar to those of the photosensitive layer than those of the surface layer by alternation of the composition of the elements contained and thus to make the intermediate layer play a role as a buffer layer on the photosensitive layer. The intermediate layer may contain only the Group 13 element and nitrogen or these elements as well as oxygen. The oxygen content therein is preferably lower than that in the surface layer. The intermediate layer may contain only a Group 13 element and oxygen, and lower oxygen content is particularly preferable, because it is possible to reduce the electric resistance and regulate the residual electric potential, by lowering the oxygen content to less than that in the surface layer.

Hereinafter, the invention will be described in detail.

<Electrophotographic Photoreceptor>

—Layer Structure of Photoreceptor—

First, the layer structure of the photoreceptor of the invention will be described.

The photoreceptor of the invention has a layer structure in which a photosensitive layer and a surface layer are laminated in this order on a conductive substrate and an intermediate layer is formed between the photosensitive and surface layers. In addition, an undercoat layer may be formed as needed between the substrate and the photosensitive layer. The photosensitive layer may be a layer consisting of two layers or more, and the photosensitive layer consisting of two layers or more may be functionally separated. The photosensitive layer in the photoreceptor of the invention may be a so-called organic photoreceptor containing an organic polymer such as organic photosensitive material or a so-called amorphous silicon photoreceptor containing silicon atoms, but the photoreceptor having a surface layer and an intermediate layer of the invention shows its advantageous effects distinctively, especially when it is an organic photoreceptor.

In the case of an amorphous silicon photoreceptor, it is possible to prevent image blurring under high humidity and also improve both durability and image quality, for example by using the surface layer of the invention as the surface region. In particular, the photosensitive layer is preferably a so-called organic photoreceptor containing an organic material such as organic photosensitive material. Use of an organic photoreceptor often results in greater abrasion, however it is possible to reduce the abrasion for example by using the surface layer of the invention as the surface region.

Hereinafter, specific examples of the layer structure of the photoreceptor of the invention will be described in detail with reference to drawings.

FIG. 1 is a schematic sectional view illustrating an example of the layer structure of the photoreceptor of the invention; and in FIG. 1, 1 represents a conductive substrate; 2 represents a photosensitive layer; 2A represents a charge-generating layer; 2B represents a charge-transporting layer; 3 represents a surface layer; and 5 represents an intermediate layer. The photoreceptor shown in FIG. 1 has a laminated layer structure of a charge-generating layer 2A, a charge-transporting layer 2B, an intermediate layer 5, and a surface layer 3 formed in this order on a conductive substrate 1, and the photosensitive layer 2 is made of two layers, a charge-generating layer 2A and a charge-transporting layer 2B.

Figure 2:
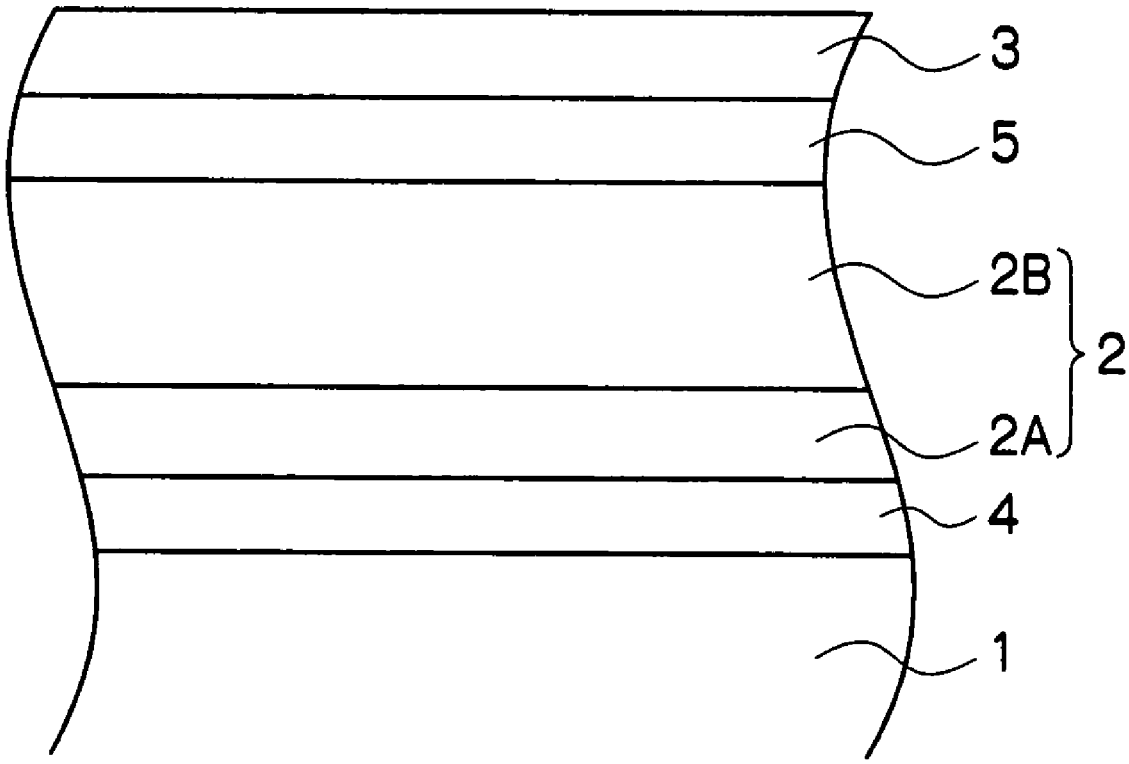
FIG. 2 is a schematic sectional view illustrating another example of the photoreceptor of the invention.

FIG. 2 is a schematic sectional view illustrating another example of the photoreceptor of the invention; and in FIG. 2, 4 represent an undercoat layer, and other numbers are the same as those described in FIG. 1. The photoreceptor shown in FIG. 2 has a laminated layer structure of an undercoat layer 4, a charge-generating layer 2A, a charge-transporting layer 2B, an intermediate layer 5, and a surface layer 3 formed in this order on a conductive substrate 1.

Figure 3:
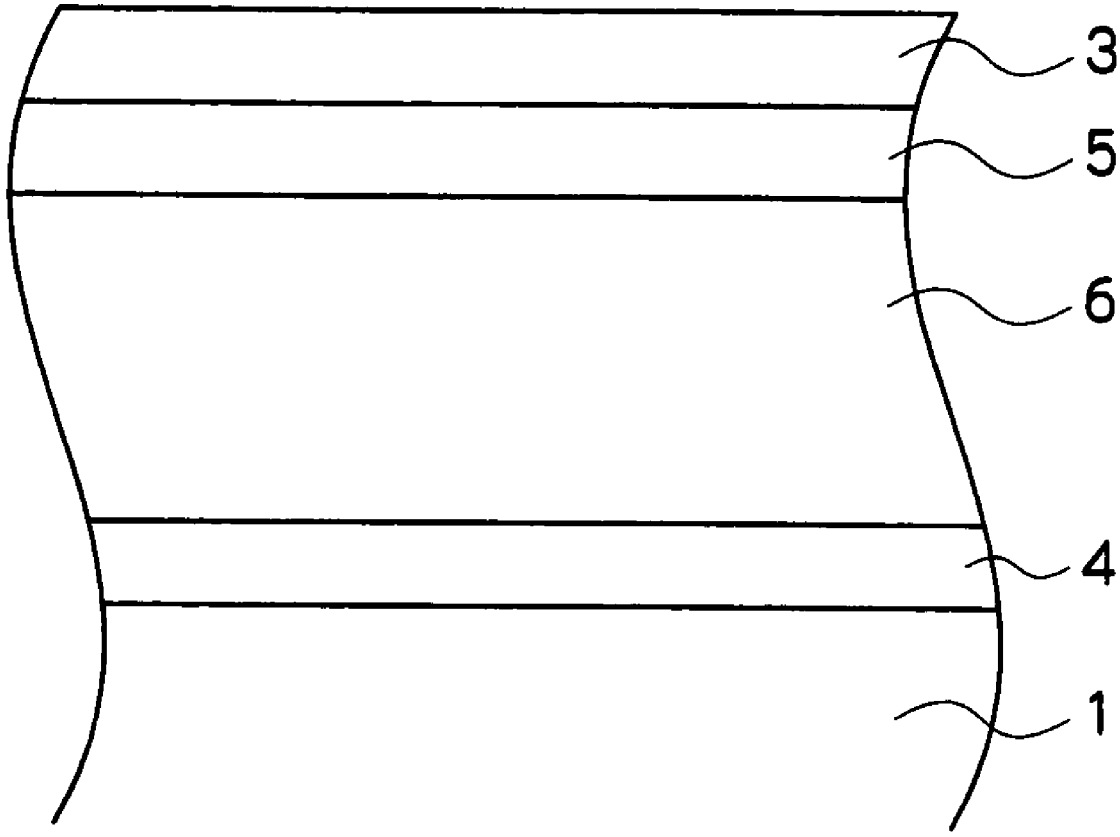
FIG. 3 is a schematic sectional view illustrating still another example of the photoreceptor of the invention.

FIG. 3 is a schematic sectional view illustrating still another example of the photoreceptor of the invention; and in FIG. 3, 6 represents a photosensitive layer; and other numbers are the same as those described in FIGS. 1 and 2. The photoreceptor shown in FIG. 3 has a laminated layer structure of an undercoat layer 4, a photosensitive layer 6, an intermediate layer 5, and a surface layer 3 formed in this order on a conductive substrate 1; and the photosensitive layer 6 is a layer having the functions of both the charge-generating layer 2A and the charge-transporting layer 2B shown in FIGS. 1 and 2.

Photosensitive layers 2 and 6 may be made of an organic polymer or an inorganic material, or alternatively a combination thereof.

—Organic Photoreceptor—

Hereinafter, favorable configuration of the photoreceptor of the invention when it is an organic photoreceptor will be described briefly.

The organic polymer compound forming the photosensitive layer may be a thermoplastic or thermocuring resin, or a resin formed in reaction of two kinds of molecules. From the viewpoint of regulation of hardness, expansion coefficient and elasticity and improvement in adhesiveness, the intermediate layer formed between the photosensitive layer and the surface layer preferably has properties intermediate between the physical properties of the surface layer and the photosensitive layer. The intermediate layer may function as a layer trapping electric charges.

In the case of an organic photoreceptor, the photosensitive layer may be a functionally separated layer having a charge-generating layer and a charge-transporting layer as shown in FIGS. 1 and 2 or a functionally integrated layer as shown in FIG. 3. In the case of a functionally separated layer, a charge-generating layer may be formed on the surface side of the photoreceptor or a charge-transporting layer may be formed on the surface side.

As in the case of the photoreceptor of the invention, it is possible to prevent decomposition of the photosensitive layer by irradiation of a short-wavelength electromagnetic wave other than heat during preparation of the surface layer by the method described below, by forming an intermediate layer on the photosensitive layer. A layer having a smaller band gap may be formed first in the initial phase of forming the surface layer, in addition to the intermediate layer, for more effective prevention of irradiation of short-wavelength light on the photosensitive layer. The composition of the layer having a smaller band gap formed on the photosensitive layer side is preferably, for example, $Ga_xIn_{(1-x)}N$ ($0 \leqq X \leqq 0.99$).

A layer containing an ultraviolet absorbent (for example, layer containing ultraviolet absorbent dispersed in polymer resin formed, for example, by coating) may be formed on the photosensitive layer surface.

Thus, it is possible to prevent the adverse effects on the photosensitive layer by the ultraviolet ray when the surface layer and others are formed and the corona discharge and the short-wavelength light such as ultraviolet ray from various light sources when the photoreceptor is used in an image-forming apparatus, by forming a protective layer on the photoreceptor surface before the surface layer and others are formed.

Hereinafter, a configuration favorable when the photoreceptor of the invention is an amorphous silicon photoreceptor will be described briefly.

The amorphous silicon photoreceptor may be a photoreceptor for positive charging or negative charging. Favorably used is a photoreceptor having an undercoat layer on a conductive substrate for blocking charge injection and improving adhesiveness and additionally a photoconductive layer and a surface layer. The surface layer may be formed on the surface of the intermediated layer previously formed on the surface of the photosensitive layer or directly on the surface of the photosensitive layer.

The top layer of the photosensitive layer (surface layer-sided layer) may be p-type amorphous silicon or n-type amorphous silicon, and an intermediate layer (charge injection-blocking layer), for example, a layer of $Si_xO_{1-x}$:H, $Si_xN_{1-x}$:H, $Si_xC_{1-x}$:H, or amorphous carbon layer, may be formed between the photosensitive layer and the surface layer.

—Surface Layer—

The entire surface layer of the photoreceptor of the invention may be consisted only of a Group 13 element and nitrogen and/or oxygen, however the surface layer may contain elements other than those above such as hydrogen and carbon as needed. By using such other elements it is possible to control the composition, structure and physical properties of the surface layer more easily and freely and achieve the advantageous effects described above at a higher level.

In particular, the surface layer preferably contains hydrogen as the other element. In such a case, it is possible to obtain a surface layer superior in electrical, chemical, mechanical stability, higher in water repellency, lower in frictional coefficient, and higher in hardness and transparency, by the compensation of dangling bond and structure defect due to binding between the Group 13 element and hydrogen.

The composition concentration (content of each component) in the surface layer may be inclined in the thickness direction. When there is concentration gradient, the composition concentration may change in the thickness direction in a single layer structure, or alternatively, a multi-layer structure of multiple layers different in composition concentration may be used.

The nitrogen concentration preferably increases in the surface-layer thickness direction of the photosensitive layer side, and the oxygen concentration decreases in the direction of the photosensitive layer side (i.e., increases in the direction of the photoreceptor surface side). More preferably, the photoreceptor is made of a Group 13 element and oxygen in the region close to the surface, and the Group 13 element and elements other than oxygen (including nitrogen) in the region close to the intermediate layer (i.e., containing no oxygen).

With such a concentration distribution, it is possible to obtain favorable mechanical durability, oxidation resistance, resistance to image defect by deposition of discharge products, and sensitivity at higher level, and to preserve the properties for an extended period of time. The concentration distribution profile in the surface-layer thickness direction is not particularly limited, and may be, for example, linear, curved, or stepwise. Alternatively, the oxygen concentration may be constant from the surface.

The ratio of the total of the Group 13 elements to the total of the nitrogen and/or oxygen in the surface layer is preferably in the range of 1.0:0.5 to 1.0:3.0. A ratio outside the range above may lead to decrease of the three-dimensional bond-forming region and increase in two-dimensional bonds and ionic molecular bonds, prohibiting sufficient chemical stability and hardness. It may also lead to coarse bonding spreading two-dimensionally, instead of the three-dimensional bonding by tridentate coordination bonds.

The hydrogen content is preferably in the range of 0.1 to 50 atom %. A hydrogen content of less than 0.1 atom % may leave structural turbulence in the bonds among the Group 13 elements and nitrogen and/or oxygen and also lead to electrical instability and insufficient mechanical properties. A hydrogen content of more than 50 atom % may increase the probability of two or more hydrogen atoms binding to the Group 13 elements and nitrogen and/or oxygen atom, disturbing the three-dimensional structure, and leading to deterioration in hardness and chemical stability, in particular in water resistance.

The hydrogen content can be determined as an absolute value by hydrogen forward scattering. It may be estimated from the strength of the bondings corresponding to Group 13 element-hydrogen and N—H bonds obtained by infrared absorption spectrum measurement.

The Group 13 element contained in the surface layer is specifically, at least one element selected from B, Al, Ga, and In, and the surface layer may contain two or more of them. In such a case, the elements other than In do not absorb visible light, and thus, the combination of the contents of these atoms in the surface layer is not particularly limited, however when In absorbing visible light is used, care should be given, for example, to the exposure wavelength and erase wavelength of the electrophotography system used, for prevention of light absorption as much as possible. Among them, the Group 13 element used in the surface layer is particularly preferably Ga.

When the intermediate layer described below is an intermediate layer containing Al and nitrogen and/or oxygen, it is preferable to use a Group 13 element other than Al, particularly preferably Ga, similarly in the surface layer.

The content of the Group 13 elements, nitrogen, oxygen, and others in the outmost layer of the surface layer is determined by XPS (X-ray photoelectronic spectrometry).

For example, it is determined by irradiating X ray at 10 kV and 20 mA by using an XPS analyzer JPS9010 MX manufactured by JOEL LTD., and MgKa ray as the X-ray source. In such a case, the photoelectronic measurement is performed in the step at 1 eV, and, as for the amount of the element, for example, the amounts of elements of Ga, N, and O are determined by measuring their 3d5/2, 1 s, and 1 s spectra respectively and calculating from the area intensity and sensitivity factor in the spectra. Ar-ion etching is performed at 500 V approximately for 10 sec. before measurement.

The content of each element in the entire surface layer is determined by secondary electron mass spectrometry or Rutherford back scattering.

The surface layer may be microcrystalline, polycrystalline, or, amorphous, but preferably amorphous for improvement in photoreceptor surface smoothness. It is more preferably amorphous containing microcrystalline and microcrystalline/polycrystalline containing amorphous, from the points of stability and hardness. The crystallinity/amorphousness can be determined by presence or absence of points and lines in the diffraction image obtained by RHEED (reflection high-energy electron diffraction) measurement.

Various dopants may be added to the surface layer for control of conductivity. For example, one or more elements selected from Si, Ge, and Sn may be used to make the n-type conductivity, while, for example, one or more elements selected from Be, Mg, Ca, Zn, and Sr may be used to make it p-type conductivity.

The surface layer often contains many bond defects, transition defects, grain boundary defects and the like in the inner structure, independently of whether the layer is microcrystalline, polycrystalline or amorphous. Thus, the surface layer may contain hydrogen and/or a halogen element for inactivation of these defects. The hydrogen and the halogen element in the surface layer have a function to eliminate reactive site and compensate electrically as they are incorporated into the bond defects, grain boundary defects and others in the crystal. Thus, they reduce the traps associated with diffusion and migration of the carrier in the surface layer and thus, prevent increase in residual electric potential by accumulation of charge when charging and photoirradiation are repeated and stabilizes the electrostatic properties of the photoreceptor surface.

(Method of Forming Surface Layer)

Hereinafter, the method of forming the surface layer will be described in more detail.

The surface layer may be amorphous or crystalline as described above, however the bottom side of the surface layer (photosensitive layer side) is preferably microcrystalline and the top side (photoreceptor surface side) microcrystalline and amorphous, for improvement in the adhesiveness to the intermediate layer and the lubricity of the photoreceptor surface. The entire layer may be microcrystalline and amorphous.

The surface layer may inject the charge diffused or transferred from the photosensitive layer during charging into the surface layer. In such a case, the charge should be trapped at the interfaces between the surface layer and the intermediate layer and between the intermediate layer and the photosensitive layer, or the charge may be trapped on the surface of the surface layer. For example, when the photosensitive layer is functionally separated as shown in FIGS. 1 and 2, if the surface layer injects electrons by negative charging, the surface layer-sided face of the charge-transporting layer may function as the charge trap, or the intermediate layer may have a function to block charge injection and trap the charge between the charge-transporting layer and the surface layer. The same is true when the photoreceptor is positively charged.

The thickness of the surface layer is preferably 0.01 to 1 μm. A thickness of less than 0.01 μm may make the layer more sensitive to the influence by the photosensitive layer and lead to deterioration in mechanical strength. Alternatively, a thickness of more than 1 μm may lead to increase in residual electric potential by repeated charging and exposure and increase in the mechanical internal stress to the photosensitive layer, causing more frequent separation and cracking.

The surface layer over the photosensitive layer and intermediate layer of the invention preferably has an entire surface roughness of less than 0.1 μm as centerline roughness. An entire surface roughness of more than 0.1 μm may cause cleaning defects, for example by blade or brush in the cleaning step in electrophotographic apparatus, and lead to deterioration in definition and image density and also to generation of image unevenness and ghost, because the image is charged, developed and transferred with the toner remaining on the surface.

The surface layer may also have a function as a charge injection-blocking layer or a charge-injecting layer. In such a case, as described above, it is possible to make the surface layer function as the charge injection-blocking layer or the charge-injecting layer, by adjusting the conductivity of the surface layer to be n-type or p-type.

When the surface layer functions also as a charge-injecting layer, the charge is trapped on the surface of the intermediate layer and the photosensitive layer (surface layer-sided face). An n-type surface layer functions as a charge-injecting layer while a p-type surface layer as a charge injection-blocking layer during negative charging. An n-type surface layer functions as a charge injection-blocking layer while a p-type surface layer as a charge-injecting layer during positive charging.

Hereinafter, the method of forming the surface layer will be described specifically. In forming the surface layer, a layer containing a Group 13 element and nitrogen and/or oxygen may be formed directly on the intermediate layer. The intermediate layer may be cleaned with plasma before film formation.

Any one of known gas phase film-forming methods, such as plasma CVD (chemical vapor deposition) method, organometallic gas-phase growth method, and molecular beam epitaxy, may be used in forming the surface layer. Hereinafter, a specific example of the method will be described with reference to drawings illustrating the apparatus used for forming the surface layer.

Figure 4A:
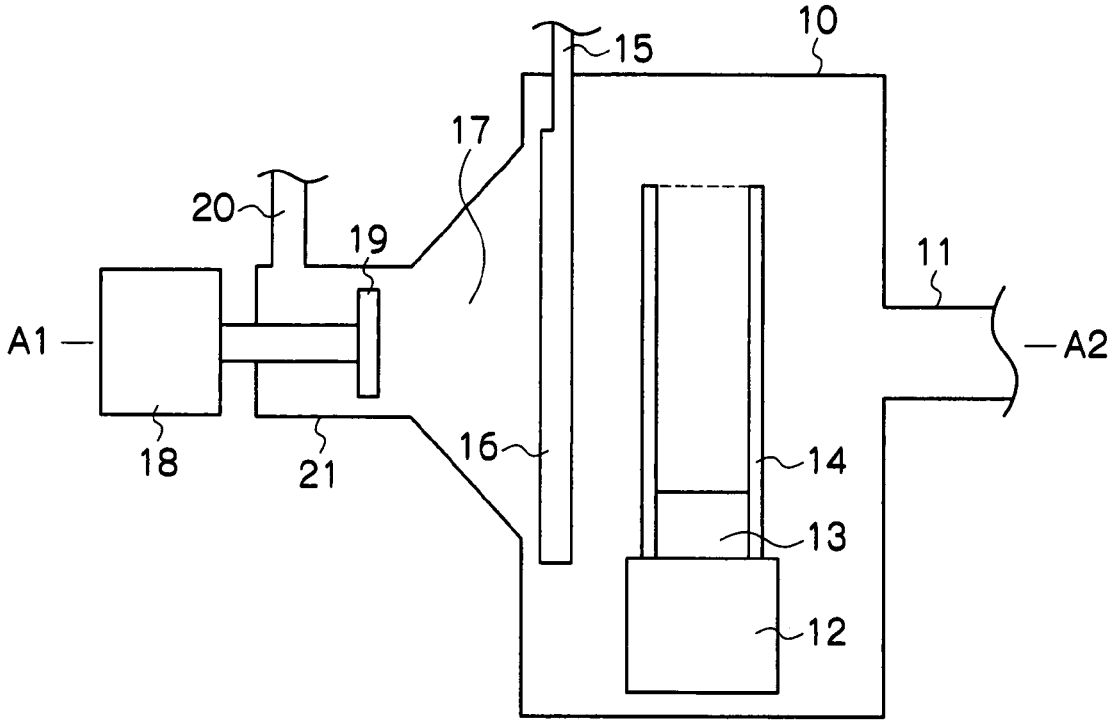
FIGS. 4A and 4B are schematic views illustrating an example of the film-forming apparatus used in forming the surface layer and intermediate layer of the photoreceptor of the invention.
Figure 4B:
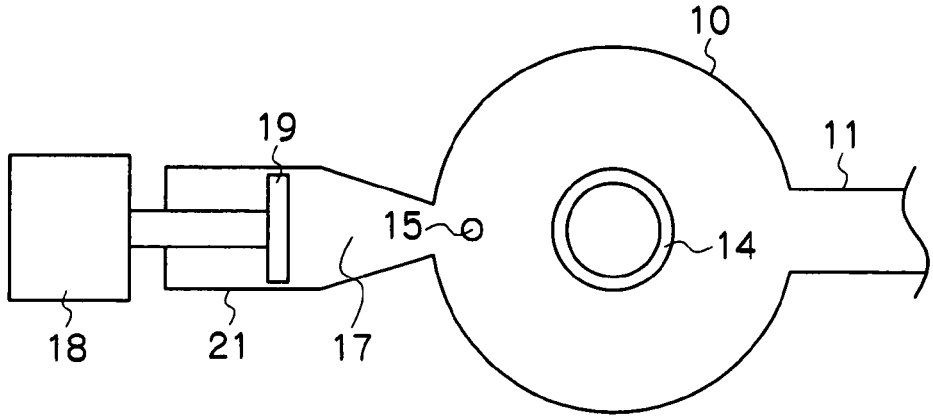

FIG. 4 is a schematic view illustrating an example of the film-forming apparatus used in forming the surface layer of the photoreceptor of the invention; FIG. 4A is a schematic sectional view illustrating the side view of the film-forming apparatus; and FIG. 4B is a schematic sectional view illustrating the film-forming apparatus shown in FIG. 4A as seen along the line A1-A2. In FIG. 4, 10 represents a film-forming chamber, 11 represents an exhaust vent, 12 represents a substrate-rotating unit, 13 represents a substrate holder, 14 represents a substrate, 15 represents a gas inlet, 16 represents a shower nozzle, 17 represents a plasma diffusion unit, 18 represents a high-frequency power supply unit, 19 represents a flat plate electrode, 20 represents a gas-supplying tube, and 21 represents a high-frequency discharge tube unit.

In the film-forming apparatus shown in FIG. 4, an exhaust vent 11 connected to a vacuum exhaust device not shown in Figure is connected to one terminal of the film-forming chamber 10, and a plasma-generating unit including a high-frequency power supply unit 18, a flat plate electrode 19 and a high-frequency discharge tube unit 21 is provided on the side opposite to the exhaust vent 11 of the film-forming chamber 10.

The plasma-generating unit has a high-frequency discharge tube unit 21, a flat plate electrode 19 placed in the high-frequency discharge tube unit 21 with its discharge face facing the exhaust vent 11, and a high-frequency power supply unit 18 placed outside the high-frequency discharge tube unit 21 and connected to the face opposite to the discharge face of the flat plate electrode 19. A gas-supplying tube 20 for supplying a gas into the high-frequency discharge tube unit 21 is connected to the high-frequency discharge tube unit 21, and the other end of the gas-supplying tube 20 is connected to a first gas supply source not shown in the Figure.

Figure 5:
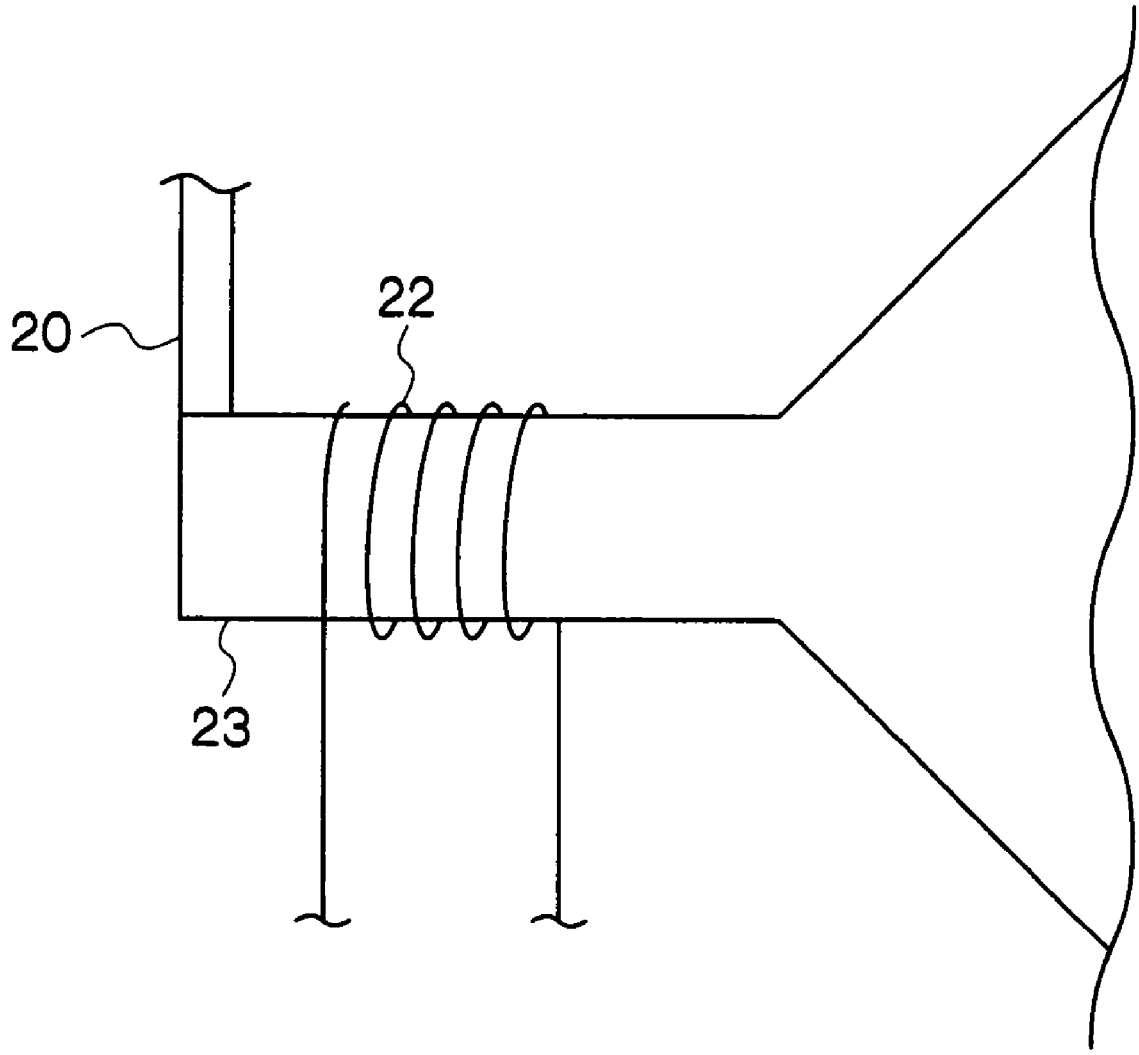
FIG. 5 is a schematic view illustrating another example of the plasma-generating unit for use in the film-forming apparatus shown in FIG. 4.

The plasma-generating unit installed in the film-forming apparatus shown in FIG. 4 may be replaced with the plasma-generating unit shown in FIG. 5. FIG. 5 is a schematic view illustrating another example of the plasma-generating unit for use in the film-forming apparatus shown in FIG. 4, and a side view of the plasma-generating unit. In FIG. 5, 22 represents a high-frequency coil, 23 represents a quartz pipe, and 20 is the same as 20 in FIG. 4. The plasma-generating unit has a quartz pipe 23 and a high-frequency coil 22 formed along the peripheral surface of the quartz pipe 23, and the other terminal of the quartz pipe 23 is connected to a film-forming chamber 10 (not shown in FIG. 5). The other end of the quartz pipe 23 is connected to a gas-supplying tube 20 for supplying gas into the quartz pipe 23.

A rod-shaped shower nozzle 16 almost in parallel with the discharge face is connected to the discharge face side of flat plate electrode 19; one end of the shower nozzle 16 is connected to a gas inlet 15; and the gas inlet 15 is connected to a second gas supply source not shown in Figure formed outside the film-forming chamber 10.

A substrate-rotating unit 12 is installed in the film-forming chamber 10; and a cylindrical substrate 14 is connected via a substrate holder 13 to the substrate-rotating unit 12 with the longitudinal direction of the shower nozzle almost in parallel with the axial direction of the substrate 14. In forming the surface layer, the substrate 14 may be rotated in the circumferential direction by rotation of the substrate-rotating unit 12. A photoreceptor previously laminated to the photosensitive layer or a photoreceptor laminated up to the intermediate layer on a photosensitive layer is used as the substrate 14.

The surface layer is formed, for example, in the following manner: When in introducing N and H, $N_2$ and $H_2$ are supplied into the high-frequency discharge pipe 21 through the gas-supplying tube 20, and a radiofrequency wave at 13.56 MHz is applied into the flat plate electrode 19 from the high-frequency power supply unit 18. A plasma diffusion unit 17 is formed then, in such a manner that the wave travels radially from the discharge face side of the flat plate electrode 19 to the exhaust vent 11 side.

It is possible to form a film containing hydrogen, nitrogen and gallium on the surface of the substrate 14, by supplying a trimethylgallium gas diluted with hydrogen, while hydrogen is used as a carrier gas, via the gas inlet 15 and the shower nozzle 16 into the film-forming chamber 10.

By generating active species while $N_2$ and $H_2$ gases are supplied into the high-frequency discharge pipe it is possible to form a compound of a Group 13 element and nitrogen containing hydrogen on the substrate by decomposition of the trimethylgallium gas at low temperature.

By activating hydrogen and nitrogen compounds simultaneously and thus allowing them to react with the Group 13 element-containing organometallic compound, it is possible to form, on the organic matter, a compound of a Group 13 element and nitrogen having a favorable film quality similar to that of the film prepared by high-temperature growth, even at a low temperature of 100° C. or lower by the etching effect of the film growing on the substrate surface by hydrogen. As a result, a stable smooth film having a centerline roughness of 0.1 μm or less is formed.

The hydrogen released by activation of the organometallic compound containing hydrogen atoms once placed in the film-forming apparatus may be used as the hydrogen source for the hydrogen activated by plasma, however the release of hydrogen from the surface is limited during low-temperature growth, and thus, it is preferable that hydrogen is activated in an amount greater than that of the nitrogen atom.

The hydrogen concentration in the mixed gas supplied for activation is 10% or more and 90% or less. A hydrogen concentration of 10% or less results in insufficient etching reaction at low temperature and generation of a hydrogen-rich Group 13 nitride compound, consequently giving a film lower in water resistance and unstable in air. A hydrogen concentration of more than 90% results in excessive etching during film growth and thus lowering the film growth rate and deteriorating film quality, consequently giving an unfavorably film with the roughened growth surface containing excessive hydrogen.

The hydrogen gas and the nitrogen gas may be supplied into the film-forming apparatus from different positions, or may be supplied after mixed. Use and activation of a gas containing both a nitrogen- and hydrogen-containing compound such as $NH_3$ and hydrogen as the source for supplying hydrogen and nitrogen is favorable, as it leads to simplification of the apparatus.

Alternatively in forming an oxygen-containing oxide layer, it is possible to activate a gas by supplying and mixing oxygen when the gas is supplied through the $N_2$ and $H_2$ gas-supplying tube 20 into the high-frequency discharge pipe 21. Alternatively, the gas is favorably activated upstream, because oxygen reacts directly with trimethylgallium. Examples of the oxygen-containing compounds for use include oxygen gas, $H_2O$, $CO_2$, CO, NO, $NO_2$, and the like.

In this case, a method of introducing oxygen atom into the film during film formation or a method of oxidizing the film after film formation may be used for introducing oxygen into the film.

In the former case, it is possible to form a surface layer containing oxygen, nitrogen and a Group 13 element by mixing an oxygen-containing gas such as oxygen gas, $N_2O$ or $H_2O$ with nitrogen gas. Alternatively, it is also possible to form a surface layer containing oxygen and gallium by generating plasma by mixing an oxygen-containing gas such as oxygen gas, $N_2O$ or $H_2O$ with a rare gas such as He or Ar and allowing it to react with an organometallic gas such as trimethylgallium gas.

On the other hand, in the latter case, the reaction may be carried out under vacuum or in air. When it is carried under vacuum, it is possible to introduce oxygen into the film by high-frequency discharge for example by using an oxygen gas diluted with a rare gas. Alternatively, other known methods such as thermal diffusion and ion injection may be used for incorporation of oxygen into film. Yet alternatively, it is also possible to oxidize it by exposing a substrate 14 having a film containing hydrogen, nitrogen and gallium formed on the rear face to corona discharge or to an oxygen or ozone atmosphere under atmospheric pressure.

In forming an organic photoreceptor, the temperature of the substrate surface during preparation of the surface layer is preferably 150° C. or lower, more preferably 100° C. or lower. The photosensitive layer may be damaged by heat even when the substrate temperature is 100° C. or lower, if the layer is heated to higher than 150° C. under influence of plasma, and thus, the substrate temperature is preferably decided, considering such influence. The temperature is a substrate surface temperature. In forming an amorphous silicon photoreceptor, the temperature is preferably 50° C. to 350° C.

The substrate temperature may be controlled by a method not shown in the Figure or may be left to natural rise of temperature during discharge. In heating the substrate 14, the heater may be placed outside or inside the substrate 14. In cooling the substrate 14, a gas or liquid for cooling may be circulated in the substrate 14.

For prevention of heating of the substrate by discharge, it is effective to adjust the flow of the high-energy gas supplied onto the surface of the substrate 14. In such a case, the condition such as gas flow rate, discharge output, and pressure is properly adjusted to make the surface have a particular temperature.

An organometallic compound containing indium or aluminum, or a hydride such as diborane, may be used as the gas containing a Group 13 element, instead of the trimethylgallium gas, and these compounds may be used in combination of two or more.

For example, by forming a film containing nitrogen and indium on the substrate 14 while trimethyl indium is supplied through the gas inlet 15 and the shower nozzle 16 into the film-forming chamber 10 in the early phase of forming the surface layer, it is possible to absorb the ultraviolet ray generated when the film is formed continuously that decomposes the photosensitive layer. It is thus possible to reduce the damage on photosensitive layer derived from the ultraviolet ray generated during film formation.

A dopant may be added to the surface layer for control of conductive type.

In adding a dopant during deposition, $SiH_4$ or $SnH_4$ in the gas state may be used for a n-type surface layer, while biscyclopentadienylmagnesium, dimethylcalcium, dimethylstrontium, dimethylzinc, diethylzinc, or the like for an p-type surface layer. A known method such as thermal diffusion or ion injection may be used for doping the dopant element into the surface layer.

Specifically, it is possible to obtain an n- or p-type conductive surface layer arbitrarily by supplying a gas containing at least one dopant element through the gas inlet 15 and the shower nozzle 16 into the film-forming chamber 10.

Presence of active hydrogen in the film-forming chamber 10 is preferable for example in the case of forming a surface layer mainly containing a Group 13 atom and nitrogen and oxygen by using a hydrogen atom-containing organometallic compound as the Group 13 element-supplying material. The active hydrogen may be supplied as the hydrogen gas used as the carrier gas or the hydrogen atom contained in an organometallic compound.

For example when a hydrogen gas and a nitrogen or oxygen gas are supplied into the film-forming apparatus from different positions in the film-forming apparatus shown in FIG. 4, multiple plasma-generating units may be installed for independent control of the activation state of hydrogen gas and the nitrogen or oxygen gas. For simplification of the apparatus, it is preferable to activate a gas containing both nitrogen and hydrogen atoms such as $NH_3$, a mixture of nitrogen and hydrogen gases or a gas containing both oxygen and hydrogen such as $H_2O$ as the material supplying the hydrogen, nitrogen or oxygen gas.

In addition, by using a rare gas such as helium and hydrogen in combination as the carrier gas, it is possible to form an amorphous compound of a Group 13 element and nitrogen and/or oxygen containing fewer hydrogen similar to that formed by high-temperature growth, by the etching effect of the film growing on the substrate 14 surface by hydrogen and the rare gas such as helium even at a low temperature of 100° C. or lower.

By the method described above, it is possible to place the activated hydrogen, nitrogen, oxygen, and the Group 13 atom on the substrate, and make the activated hydrogen accelerate release of the hydrogen in the hydrocarbon group of the organometallic compound such as methyl or ethyl group as molecular hydrogen. Thus, a hard surface layer in which hydrogen, nitrogen, oxygen and the Group 13 element are bound to each other three-dimensionally is formed on the substrate surface at low temperature.

Ga and N form a sp3 bond like carbon atoms in diamond, different from the sp2-bonding carbon atoms contained in silicon carbide in such a hard film, and thus, the film is transparent. The hard film can be converted into an oxygen-containing film, for example, by natural oxidation or oxidation with oxygen or ozone after film formation; the resulting film is transparent and hard; and the film surface is water-repellent, higher in lubricity and lower in friction.

The plasma-generating unit in the film-forming apparatus shown in FIG. 4 is a device employing a high-frequency oscillator, however is not limited thereto, and examples thereof include microwave oscillator, electrocyclotron resonance system, and helicon plasma system. The high-frequency oscillator when used may be an induction or capacitance oscillator.

A high-frequency oscillator is preferable for prevention of heating of the substrate by plasma irradiation, and a device for preventing heat irradiation may be installed additionally.

These apparatuses may be used in combination of two or more, or similar apparatuses may be used in combination of two or more.

When two or more different plasma-generating devices (plasma-generating units) are used, the plasma should be discharged from the devices at the same pressure. There may be a pressure difference between the region discharged and the film-forming region (region of the substrate installed). These apparatuses may be installed in series or in parallel in the gas flow direction from gas inlet to gas outlet in the film-forming apparatus, and any apparatus may be placed at the position facing the film-forming face of the substrate.

When two kinds of plasma-generating units are installed in series with respect to the gas flow, for example in the film-forming apparatus shown in FIG. 4, one of them may be used as a second plasma-generating device discharging in the film-forming chamber 10 by using the shower nozzle 16 as the electrode. In such a case, it is possible to cause discharge in the film-forming chamber 10 by using the shower nozzle 16 as the electrode, by applying high-frequency voltage to the shower nozzle 16 via the gas inlet 15.

Alternatively instead of using the shower nozzle 16 as an electrode, it is possible to form a cylindrical electrode between the substrate 14 and the plasma diffusion unit 17 in the film-forming chamber 10 and cause discharge in the film-forming chamber 10 by using the cylindrical electrode.

When two different kinds of plasma-generating devices are used under the same pressure, use of a microwave oscillator and a high-frequency oscillator allows significant alteration of the excitation energy for excitation species and is effective in controlling film quality. The discharge may be performed at a pressure close to atmospheric pressure. When the discharge is performed at a pressure close to atmospheric pressure, the carrier gas for use is preferably He.

In forming the surface layer, ordinary methods such as organometallic gas-phase growth and molecular beam epitaxy may be used instead of the methods described above, however use of active nitrogen and/or active hydrogen is also effective for lowering the reaction temperature in forming the film by these methods. In such a case, a gas, vapor of a liquid, or a gas generated by bubbling with a carrier gas, such as of $N_2$, $NH_3$, $NF_3$, $N_2H_4$, or methyl hydrazine, may be used as the nitrogen raw material.

—Intermediate Layer—

The photoreceptor of the invention has essentially an intermediate layer between the surface layer and the photosensitive layer. The intermediate layer is preferably a layer having a hardness and expansion coefficient between those of the photosensitive layer and the surface layer, for reduction in the mechanical stress due to the difference in hardness and expansion coefficient between the surface layer and the photosensitive layer. The surface layer becomes a denser surface layer lower in friction, higher in water repellency, higher in mechanical strength and more resistant to deposition of discharge products, when the lower layer is harder.

From the viewpoint above, the intermediate layer of the invention is preferably (1) a layer containing a curable organic resin layer or (2) a layer containing Al and nitrogen and/or oxygen.

The intermediate layer is preferably a layer more adhesive to the photosensitive layer, however use of a solvent in forming the intermediate layer is undesirable if it dissolves the photosensitive layer.

In addition, the intermediate layer should be transparent to the light at the wavelength for irradiation on the photoreceptor in the image-forming apparatus. Examples of the lights include lights at the radiation-source wavelength or the erase-light-source wavelength. Further, the intermediate layer is preferably a layer containing an ultraviolet absorbent.

(1) Curable Organic Resin Layer

The organic resin layer may be a thermosetting resin layer or a layer formed in reaction of two kinds of molecules. The intermediate layer of a curable organic resin is formed by preparing a coating solution by dissolving an organic resin and other components in a solvent and coating and drying the solution on a photosensitive layer.

Examples of the thermosetting organic resins include silicone-alkyd resins, melamine resins, acetal resin, and the like.

The thermosetting organic resin when used is heated after application, and the temperature then is preferably 50 to 170° C., more preferably 60 to 150° C. The heating period is in the range of 5 to 200 minutes, and is preferably adjusted properly according to the temperature.

Examples of the organic resins forming a layer in combination of two kinds of molecules include polyurethane resins, acrylic resins, epoxy resins, acryl silicone resins, epoxy-modified silicone resins, phenol-formaldehyde resins, and the like, and, among them, polyurethane resins, acrylic resins, and phenol-formaldehyde resins are particularly preferable.

Examples of the other components include ultraviolet absorbents, antioxidants, and the like.

Examples of the ultraviolet absorbents include benzophenone ultraviolet absorbents, benzotriazole ultraviolet absorbents, benzoate ultraviolet absorbents, acrylonitrile ultraviolet absorbents, and the like.

Examples of the antioxidants include hindered phenol-based antioxidants, hindered amine-based antioxidants, and the like.

The solvent is preferably an alcohol-based solvent. Examples thereof include ethanol, isopropyl alcohol, and butanol, and, in addition, ethyl acetate, butyl acetate and others are used favorably.

The intermediate layer may be insulative from the viewpoint of electric resistance, but, in such a case, the thickness of the intermediate layer is preferably thinner, considering the residual electric potential. When the intermediate layer is semiconductive, the layer preferably has a resistance of $10^9$ to $10^{13}$ Ωcm, for facilitating formation of electrostatic latent image. The semiconductive material may be an organic semiconductor or a film containing an organic or inorganic conductive powder dispersed. A low-molecule weight charge-transporting material may be added for giving an electric charge-transporting property. The intermediate layer may be modified to transport charges by introducing chemical bonds in the polymer chain. The low-molecular weight charge-transporting material may be dissolved or chemically bound to a polymer resin, for control of the residual electric potential. The materials for use in the charge-transporting layer described below may be used.

Examples of the inorganic materials (inorganic conductive powders) for use include alkoxides of titanium and zirconium, acetylacetone compounds, silane compounds, and the like.

In addition, the intermediate layer of a curable organic resin is particularly preferably hardened by exposure to plasma. It is possible to harden and densify the intermediate layer and convert the surface into a low-energy surface by treating the intermediate layer thus formed by coating and drying with a plasma of tetrafluoromethane and nitrogen or that of tetrafluoromethane, nitrogen and a rare gas.

Use of a compound forming a plasma-polymerization film when mixed with tetrafluoromethane in the plasma is preferably avoided, because it gives a layer lower in hardness. For example, use of a mixed gas containing a hydrogen-containing compound such as hydrogen or methane is undesirable, because it give a carbon fluoride film or the like in the plasma. Alternatively, use of tetrafluoroethylene, which gives a polymerization film, is also undesirable. Thus, use of a compound that does not form a polymerization film such as nitrogen or a rare gas as it is mixed with tetrafluoromethane is preferable for forming a hard fluorine-containing modified layer. Particularly preferable is nitrogen. Nitrogen seems to be used directly as a radical for forming a crosslinked structure of the binders and also for facilitating fluorination of the binder element, in particular of bound hydrogen. Use of a rare gas, which causes chain cleavage for facilitating formation of the crosslinked structure of the resin itself in the so-called casing treatment, is effective in hardening the layer and reducing the surface energy thereof by incorporation of fluorine from tetrafluoromethane and by crosslinking.

Treatment with a plasma of hydrogen and nitrogen, or with hydrogen, nitrogen and rare gas, is also favorable, and hardens and densifies the intermediate layer.

Generation of the hard layer can be judged by examining whether the surface hardened by the plasma is insoluble by wetting the surface with a solvent.

The thickness of the intermediate layer of curable organic resin is preferably 0.5 to 10 μm, more preferably 1 to 5 μm.

(2) Layer Containing Al and Nitrogen and/or Oxygen

The intermediate layer containing Al and nitrogen and/or oxygen may be a laminate of a compound of Al and nitrogen and a compound of Al and oxygen, a laminate of a compound of Al and nitrogen and a compound of the other Group 13 element (e.g., Ga) and nitrogen, or a laminate of a compound of Al and oxygen and a compound of the other Group 13 element (e.g., Ga) and nitrogen.

The intermediate layer is prepared in reaction of an aluminum-containing compound and a nitrogen- or oxygen-containing compound. The reaction is preferably carried out under plasma, when the substrate (photosensitive layer-carrying substrate) temperature is from the room temperature to 100° C. Compounds containing these elements may be introduced into the plasma simultaneously, or an aluminum-containing compound may be introduced to the downstream of a non-film-forming reactive plasma containing nitrogen and oxygen and decomposed therein, allowing reaction with nitrogen and oxygen on the substrate.

Use of the method of forming a surface layer described above in forming the intermediate layer containing Al and nitrogen and/or oxygen is preferable, because it gives a continuous film.

The intermediate layer may be insulative from the viewpoint of electric resistance, but, in such a case, the thickness of the intermediate layer is preferably thinner, considering the residual electric potential. Alternatively when the intermediate layer is semiconductive, it preferably has a resistance of $10^9$ to $10^{13}$ Ωcm for not hindering electrostatic latent image formation. The intermediate layer may be doped with other element for control of residual electric potential.

The thickness of the intermediate layer containing Al and nitrogen and/or oxygen is preferably 0.01 to 1 μm, more preferably 0.02 to 0.5 μm.

The intermediate layer may have two or more layers, and may be, for example, a laminate intermediate layer having both a curable organic resin layer (1) and a layer containing Al and nitrogen and/or oxygen (2). In such a case, the curable organic resin layer (1) and the layer containing Al and nitrogen and/or oxygen (2) are preferably laminated on the photosensitive layer in this order.

The intermediate layer 5 in the embodiment of the invention is formed between the photosensitive layer 2 and the surface layer 3. In particular, in the electrophotographic photoreceptor having an inorganic thin film containing the Group 13 element and at least one element selected from nitrogen or oxygen described below, in the embodiment of the invention it is possible to prevent the mechanical stress due to the difference in hardness and expansion coefficient between the surface layer 3 and the photosensitive layer 2, and the fatigue of the charge-transporting layer and others by irradiation of plasma electron and ion, UV, or the like during film formation, by forming an intermediate layer containing a Group 13 element and at least one element selected from nitrogen or oxygen. It is also possible, for example, to separate electric properties and mechanical and chemical stability functionally, reduce residual electric potential, and improve cycle characteristics and resistance to environmental fluctuation.

It is also possible to prevent influence on the photosensitive layer 2 by the corona discharge and the short-wavelength light from various light sources such as ultraviolet ray when the photoreceptor is used in an image-forming apparatus. In particular, it is possible to prevent problems which is caused when there is no intermediate layer such as the microcracks and defects generated on the photosensitive layer surface and deterioration in electric charge-transporting property, by the internal stress present in the charge transport layer immediately after film formation when the surface layer 3 is thickened and by the mechanical stimuli applied cumulatively by cleaner system, paper and transfer mechanism during print output, and also the irregularity in image density caused by uneven transportation, As a result, it is possible to provide an electrophotography organic photoreceptor superior in surface mechanical durability and oxidation resistance, resistant to the image defect due to deposition of discharge products, higher in sensitivity, and easier in retaining favorable characteristics, such as output of an image superior in uniformity, at high level over time.

The intermediate layer 5 is a layer containing the Group 13 element and at least one of nitrogen or oxygen, but may be a laminate of a compound of a Group 13 element and nitrogen and a compound of a Group 13 element and oxygen. Specifically, it may be a laminate of a compound of Ga and nitrogen and a compound of Al and oxygen or a laminate of a compound of Ga and nitrogen and a compound of Ga and oxygen. Yet alternatively, it may be a laminate of a compound of Ga and oxygen and a compound of Ga and nitrogen.

In any case, the intermediate layer in the embodiment of the invention 5 is desirably higher in hardness and transparency, and a layer having a thermal expansion coefficient between those of the surface layer 3 and the photosensitive layer 2 and superior in adhesiveness to the photosensitive layer 2 is preferable.

Specifically, the Group 13 element contained in the intermediate layer 5 is preferably at least one element selected from B, Al, Ga, and In; and two or more elements selected from these elements may be used in combination.

In such a case, the content of these atoms in the intermediate layer is not particularly limited; among the four elements, In absorbs light in the visible light region, while the other elements do not absorb light in the visible light region; and thus, it is possible to adjust the wavelength region of the intermediate layer 5 sensitive to light by properly selecting the Group 13 element to be used. For example, the element for the intermediate layer 5 should be selected so that the light of the electrophotographic system at the exposure wavelength and the erase wavelength is adsorbed as small as possible.

In the embodiment of the invention, both the surface layer 3 and the intermediate layer 5 contain a Group 13 element, nitrogen and/or oxygen, however at least the kind or the composition of the elements contained in the layers is different from each other. Specifically, for obtaining the favorable characteristics described above, as for the kind of the elements contained in the intermediate layer 5 with respect to that in surface layer 3, the intermediate layer 5 is preferably a nitride when the surface layer 3 is an oxide, and the intermediate layer 5 is the nitride of a different Group 13 element when the surface layer 3 is a nitride; as for the composition ratio of the elements contained, the oxygen concentration in the intermediate layer 5 is preferably lower than that in the surface layer 3. In such a case, the case where the oxygen concentration differs only in the range of several % is also included, if these layers are different, for example, in visible absorption spectrum or conductivity.

More specifically, for example, the intermediate layer 5 preferably contains a compound of Al and nitrogen when the surface layer 3 contain a compound of Ga and nitrogen; and, when the surface layer 3 contains a compound of Ga and oxygen, the intermediate layer 5 preferably contains a compound of Ga and nitrogen or a compound of Al and nitrogen (which may contain oxygen additionally).

When the surface layer 3 contains a compound of Ga, oxygen and nitrogen, the intermediate layer 5 preferably contains a compound containing similar elements (however in such a case, the composition ratios of the layers are different).

When the intermediate layer 5 contains nitrogen and/or oxygen and a Group 13 element, the atom number ratio of these elements (nitrogen/oxygen: Group 13 element) is preferably 0.5:1 to 3:1. A ratio outside the range above may lead to decrease of the region having tetrahedral bonds and three-dimensional bonds and increase in the region having ionic molecular bonds, consequently decreasing sufficient chemical stability or hardness.

When the intermediate layer 5 contains oxygen and a Group 13 element, the atom number ratio of these elements is 0.1:1 to 3:1. A ratio of less than 0.1:1 leads to decrease in electric resistance, prohibiting favorable retention of the latent image. A ratio of more than 3:1 or more leads to increase in the defects in film, prohibiting sufficient chemical stability or hardness.

The composition of the Group 13 element, nitrogen and/or oxygen in the thickness direction of the intermediate layer 5 may be constant, however the distribution of nitrogen concentration may increase in the thickness direction of the intermediate layer 5 toward the substrate and the distribution of oxygen concentration may decrease toward the substrate side; when it contains both nitrogen and oxygen, the distribution of nitrogen concentration may decrease toward the substrate side and the distribution of oxygen concentration increase toward the substrate side.

The intermediate layer 5 may contain only a Group 13 element and nitrogen and/or oxygen, but preferably contains additionally elements such as hydrogen, particularly hydrogen, as needed. In such a case, the hydrogen compensates dangling bond and structural defects generated by bonding among the Ga element, nitrogen and oxygen, improving electrical stability, chemical stability, and mechanical stability and giving an intermediate layer superior in hardness and transparency with a highly water-repellent surface.

When the intermediate layer contains hydrogen, the content of hydrogen in the intermediate layer is preferably in the range of 0.1 atom % or more and 40 atom % or less, more preferably in the range of 0.5 atom % or more and 30 atom % or less. A hydrogen content of less than 0.1 atom % may leave structural turbulence in film, making it electrically unstable or unfavorable in properties. A hydrogen content of more than 40 atom % may lead to increase in the possibility of two or more hydrogen atoms binding to the Group 13 element and nitrogen atom, prohibiting formation of three-dimensional structure and leading to deterioration in hardness and chemical stability (in particular, water resistance).

The amount of hydrogen contained in the intermediate layer 5 is preferably in the range of 0.1 atom % or more and 50 atom % or less, more preferably in the range of 1 atom % or more and 40 atom % or less, with respect to the total amount of the main two elements (Group 13 element and oxygen or Group 13 element and nitrogen) constituting the intermediate layer 5.

In the present embodiment of the invention, the hydrogen content in the intermediate layer is a value determined by hydrogen forward scattering (HFS). The measurement method will be described below.

The intermediate layer may contain carbon additionally, but, in such a case, its content is preferably 15 atom % or less. A carbon content of more than 15 atom % may lead to increase in the amount of hydrogen contained in the intermediate layer, because carbon is present as —$CH_2$ and —$CH_3$ in the intermediate layer, and consequently, to deterioration for example of the chemical stability of the intermediate layer in air.

In the embodiment of the invention, the contents of the elements such as of the Group 13 element, nitrogen, oxygen, and carbon in the intermediate layer and also the distribution thereof in the layer thickness direction are determined by Rutherford back-scattering (RBS). The measurement method well be described below.

The intermediate layer 5 may be crystalline or noncrystalline, and also, may be microcrystalline, polycrystalline, or amorphous.

The intermediate layer 5 may be microcrystalline amorphous, or microcrystalline/polycrystalline containing amorphous, from the points of stability and favorable hardness, but is preferably amorphous from the points of intermediate layer surface smoothness and friction. The crystallinity/amorphous can be judged by presence or absence of the points and lines in the diffraction image obtained by RHEED (reflection high-energy electron diffraction) measurement. The amorphousness can be judged by absence of the sharp peak at the diffraction angle inherent to crystal by X-ray diffraction spectrum measurement.

Various dopants may be added to the intermediate layer 5 for control of conductivity. For example, one or more elements selected from Si, Ge, and Sn may be used for controlling the conductivity of the intermediate layer 5 to be n-type, while for example, one or more elements selected from Be, Mg, Ca, Zn, and Sr may be used for controlling it to be p-type. Normally, such an undoped intermediate layer 5 is mostly n-type, and an element used in controlling it to be p-type may be used for further improvement in dark resistance.

Even when the crystallinity/noncrystallinity of the intermediate layer 5 in the embodiment of the invention is microcrystalline, polycrystalline or amorphous, the layer often contains many bond defects, transition defects, grain boundary defects, and the like in the structure. Thus, hydrogen and/or a halogen element may be added to the semiconductor film for inactivation of these defects. The hydrogen and the halogen element in the intermediate layer are incorporated, for example, into the bond defects, leading to elimination of reactive sites and electrical compensation, thus suppressing the trapping of diffusion and migration of the carrier in the semiconductor film.

When such an intermediate layer 5 is formed under the surface layer 3 of photoreceptor, it is possible to suppress the increase in the residual electric potential on the photoreceptor surface by accumulation of charges when charging and exposure are repeated, prevent cycle up, and stabilize charging properties further.

The method of forming the intermediate layer 5 will be described below in detail, however the intermediate layer 5 of the embodiment of the invention is prepared, for example, in reaction of a gallium-containing compound and a nitrogen- and oxygen-containing compounds. The reaction is preferably carried out under plasma at a substrate temperature of room temperature to 100° C. The compounds containing these elements may be added simultaneously into the plasma, or a gallium-containing compound may be added to and decomposed at a position downstream of non-film-forming reactive plasma containing nitrogen or oxygen, allowing reaction with nitrogen or oxygen on the substrate. The method of forming a surface layer shown below is preferable, because it gives a continuous film.

The intermediate layer 5 formed may be an insulative layer, however in such a case, the thickness of the intermediate layer should be decided according to the residual electric potential. Alternatively when it is a semiconductive layer, the volume resistivity is preferably in the range of $10^{+8}$ to $10^{+13}$ Ωm for facilitating latent image formation.

The thickness of the intermediate layer 5 is preferably in the range of 0.01 to 1 μm, more preferably 0.02 to 0.7 μm.

The surface layer 3 in the embodiment of the invention is a layer formed on the intermediate layer containing the Group 13 element and at least one element selected from nitrogen or oxygen layer, similarly to the intermediate layer.

The surface layer 3 is, for example, a Group 13 element oxide or nitride semiconductor containing a Group 13 element, nitrogen and oxygen and is superior in hardness and transparency. When it contains oxygen as in the intermediate layer 5, the layer is superior in oxidation resistance even in air or in oxidative atmosphere, and shows very small change in physical properties over time. The semiconductor film in such a composition may be formed on a photosensitive layer containing an organic material, by the surface layer-forming method described below.

The surface layer 3 in the embodiment of the invention is a layer containing the Group 13 element and at least one element selected from nitrogen or oxygen similarly to the intermediate layer 5, and thus, the basic properties thereof are the same as those for the intermediate layer, except that the condition of layer formation and the layer thickness, for example, are changed.

Examples of the compounds contained in the surface layer 3 include mainly, a compound containing a Group 13 element and oxygen, a compound containing a Group 13 element and nitrogen, and a compound containing a Group 13 element, oxygen and nitrogen.

When the surface layer 3 contains a Group 13 element and oxygen, the oxygen content is preferably more than 15 atom %. An oxygen content of 15 atom % or less may lead to instabilization of the semiconductor film under oxygen-containing atmosphere, generation of hydroxyl group by oxidation, and change in physical properties such as electrical and mechanical properties over time. It also lowers the electric resistance and prohibits preservation of electrostatic latent image.

The oxygen content is preferably higher for preservation of the oxidation resistance, however higher oxygen content may make the film softer and brittle, because the molecular bonds among elements in the surface layer film become more two-dimensional. Alternatively when it is formed only with the Group 13 element and oxygen, an oxygen content of 15 atom % or less may lead to deterioration in electric resistance, prohibiting retention of the electrostatic latent image.

The oxygen content in the surface layer is more preferably 28 atom % or more and still more preferably 37 atom % or more. The oxygen content is practically, preferably 65 atom % or less. Even in such a case, the nitrogen content in the surface layer is preferably 1 atom % or more. The surface layer may contain nitrogen in an amount of 1 atom % or more.

On the other hand, when the surface layer 3 contains a Group 13 element and nitrogen, the thickness of the surface layer 3 is preferably 0.01 μm or more and less than 5 μm, and the average center-line surface roughness (Ra) after film formation is preferably 0.1 μm or less.

An average center-line surface roughness (Ra) of more than 0.1 μm causes cleaning defects for example by the blade or brush in the cleaning step in the electrophotographic system (image-forming apparatus) and allows charging, developing, and transfer of image while the toner is held on the surface, which leads to deterioration in definition and image density and also to image unevenness and generation of ghosts. In addition, the lower layer photosensitive layer 2 becomes damaged naturally at a center-line average roughness (Ra) of more than 0.1 μm, resulting in deterioration in sensitivity and increase in residual electric potential.

The average center-line surface roughness (Ra) is preferably 0.07 μm or less, more preferably 0.05 μm or less.

The surface layer 3 having a thickness of less than 0.01 μm is more sensitive to the influence by the photosensitive layer 2 and is also insufficient in mechanical strength. On the other hand, a thickness of 5 μm or more may lead to rise in the residual electric potential by repeated charging and exposure, strengthening of the mechanical internal stress to the photosensitive layer, and easier separation and cracking. The thickness of the surface layer is preferably in the range of 0.03 to 3 μm, more preferably in the range of 0.05 to 2 μm.

The average center-line surface roughness (Ra) is an average of the measurements of the photoreceptor at any 10 positions in the axial direction, as determined by using a surface roughness profilometer Surfcom 550A manufactured by Tokyo Seimitsu Co. Ltd., at a cutoff value of 75%, a measurement distance of 1.0 mm, and a scanning speed of 0.12 mm/sec.

The thickness of the surface layer is determined by a combination of measurement with a stylus level difference analyzer (surface roughness meter, manufactured by Tokyo Seimitsu Co. Ltd.) and a cross-sectional photograph of the semiconductor film obtained under a scanning electron microscope (S-400, manufactured by Hitachi).

The Group 13 element contained in the surface layer 3 is specifically at least one element selected from B, Al, Ga, and In; and two or more element selected from these elements may be used in combination.

In such a case, the combination of the contents of these atoms in the surface layer is not particularly limited; but, among the four elements, In absorbs light in the visible light region, and the elements other than In do not absorb light in the visible light region; and thus, it is possible to adjust the wavelength region of the intermediate layer 5 sensitive to light properly by selecting the Group 13 element to be used. For example when the semiconductor film of the invention is used as the surface layer of the photoreceptor, the element for the semiconductive layer should be selected so that the light at the exposure wavelength and the erase wavelength of the light of the electrophotographic system is adsorbed as small as possible.

The atom number ratio of the nitrogen and/or oxygen to the Group 13 element in the surface layer 3 is preferably 0.5:1 to 3:1. A ratio outside the range above may lead to decrease of the region having tetrahedral bonds and increase in the region having ionic molecular bonds, consequently prohibiting sufficient chemical stability or hardness.

The composition of the surface layer 3 in the thickness direction may be constant, however if the layer contains a Group 13 element and oxygen, the composition may be inclined in the film thickness direction, or the layer may have a multi-layer structure. The layer has a distribution of nitrogen concentration increasing in the thickness direction of the surface layer 3 toward the substrate side, and the distribution of oxygen concentration may decrease in the direction of the substrate side; or oppositely, the distribution of nitrogen concentration distribution may decrease toward the substrate side, and the distribution of oxygen concentration increase toward the substrate.

The surface layer 3 may contain only a Group 13 element, oxygen and/or nitrogen, but, if the surface layer contains only oxygen and a Group 13 element and the intermediate layer only oxygen and a Group 13 element, the interface between the surface layer and the intermediate layer should be discontinuous and the oxygen concentration in the intermediate layer be lower than that in the surface layer. In addition, the surface layer 3 may contain the fourth element such as hydrogen as needed in addition to the Group 13 element, oxygen, and nitrogen, and it particularly preferably contains hydrogen. In such a case, the hydrogen compensates dangling bond and structural defects generated by bonding among the Group 13 element, nitrogen and oxygen, improving electrical stability, chemical stability, and mechanical stability and giving an intermediate layer superior in hardness and transparency with a highly water-repellent surface having a low frictional coefficient.

When the surface layer film contains hydrogen, the hydrogen content in the surface layer film is preferably in the range of 0.1 atom % or more and 40 atom % or less, more preferably in the range of 0.5 or more and 30 atom % or less.

A hydrogen content of less than 0.1 atom % may leave structural turbulence in film, making it electrically unstable or unfavorable in mechanical properties. Alternatively, a hydrogen content of more than 40 atom % may lead to increase in the possibility of two or more hydrogen atoms binding to the Group 13 element and nitrogen atom, prohibiting three-dimensional structure and leading to deterioration in hardness and chemical stability (in particular, water resistance).

In addition, the amount of hydrogen contained in the surface layer is preferably in the range of 0.1 atom % or more and 50 atom % or less, more preferably in the range of 1 atom % or more and 40 atom % or less, with respect to the total amount of the main two elements (Group 13 element and oxygen or Group 13 element and nitrogen) constituting the surface layer.

The hydrogen quantity can be determined by hydrogen forward scattering (hereinafter, referred to as "HFS" in some cases) in the following manner (the hydrogen quantity in the intermediate layer is also determined similarly):

The accelerator used in HFS is 3SDH Pelletron manufactured by NEC; the end station used is RBS-400 manufactured by CE&A; and the system used is 3S-R10. HYPRA program provided by CE&A is used for analysis. The HFS measuring condition is as follows:

$He^{++}$ ion beam energy: 2.275 eV

Detection angle: Grazing Angle 30° with respect to 160° incident beam

In HFS measurement, it is possible to collect hydrogen signals scattering in front of a sample by placing a detector at a position at an angle of 30° and a sample at an angle of 75° with respect to $He^{++}$ ion beam. The detector is preferably covered then with a thin aluminum foil for removal of He atom scattering with hydrogen. Quantitative determination is performed by comparing the hydrogen count of test sample with that of the reference sample after normalization with blocking power.

The reference sample used is a Si sample ion-injected with H, or white mica. The white mica is known to have a hydrogen concentration of approximately 6.5 atomic %. The amount of H absorbed on the outmost layer can be calculated by subtracting the H amount adsorbed on a clean Si surface.

The hydrogen amount in the layer can be estimated from the intensity of the Group 13 element-hydrogen and N—H bonds obtained by infrared absorption spectrum measurement. In measurement of infrared absorption spectrum, a sample may be formed on an infrared-transmitting substrate under the condition the same as that during film formation; or the film may be separated from the photoreceptor and the sample may be analyzed as a KBr tablet. When the photosensitive layer is an organic photoreceptor, the residue after solubilization with an organic solvent may be used. Alternatively when it is an amorphous silicon, the surface may be scraped, or the entire silicon may be separated.

The infrared absorption spectrum measurement is performed by using a Spectrum One Fourier transform infrared absorption analyzer system B manufactured by Perkin Elmer at an S/N of 30,000:1 and a resolution of 4 $cm^{-1}$. A sample formed on a silicon wafer of 10 mm×10 mm in size is placed and measured on a test piece stage equipped with a beam condenser. A silicon wafer carrying no film is used for reference.

For example, the halfband width of GaN absorption is defined as the width of the absorption peak in the horizontal direction at the position half of the vertical line descending from the peak of the GaN absorption peak to the base line of the straight line connecting the absorption valleys at 1,100 $cm^{-1}$ and 800 $cm^{-1}$ extrapolated toward the low-wavelength side.

The surface layer may contain carbon, however the content then is preferably 15 atom % or less. A carbon content of more than 15 atom % may lead to increase in the amount of hydrogen contained in the surface layer, because carbon is present as —$CH_2$ and —$CH_3$ in the surface layer, and consequently, to deterioration for example of the chemical stability of the surface layer in air.

The contents of the elements such as the Group 13 element, nitrogen, oxygen, and carbon in the surface layer and also the distribution thereof in the layer thickness direction are determined in the following manner by Rutherford back-scattering (RBS) (similarly to the measurement of the Group 13 element and others in the intermediate layer).

The accelerator used in RBS is 3SDH Pelletron manufactured by NEC; the end station used is RBS-400 manufactured by CE&A; and the system is 3S-R10. HYPRA program provided by CE&A is used for analysis. As for the RBS measuring condition, the $He^{++}$ ion beam energy is 2.275 eV; the detection angle, 160°; the grazing angle with respect to the incident beam, 109°.

The RBS measurement is specifically performed in the following manner:

First, $He^{++}$ ion beam is irradiated vertically on a sample; a detector is placed at an angle of 160° to the ion beam; and the signal of He scattered backward is determined. The composition and the layer thickness thereof are determined from the He energy and intensity detected. The spectrum may be measured from two detection angles, for improvement in the accuracy of the composition ratio and layer thickness. It is possible to improve accuracy by crosschecking the results by measurement from two detection angles different in resolution in the depth direction and backward scattering kinetics.

The number of He atoms scattered backward by the target atom depends only on three components: 1) the atomic number of target atom, 2) the energy of He atom before scattering, and 3) the scattering angle. The density is calculated from the measured composition, and the layer thickness is calculated from the density. The error of density is not more than 20%.

Even when an intermediate layer and a surface layer are formed continuously on a photosensitive layer as in the embodiment of the invention, it is possible to determine the element composition of the surface layer and the intermediate layer respectively without destruction of the surface layer region by the measurement method.

In addition, the content of each element in the entire surface layer can be determined by secondary electron mass spectrometry or XPS (X-ray photoelectronic spectrometry).

The surface layer 3 may be crystalline or noncrystalline, and may also be microcrystalline, polycrystalline, or amorphous.

The surface layer may be amorphous containing microcrystalline, or microcrystalline/polycrystalline containing amorphous, from the points of stability and hardness, but is preferably amorphous from the points of surface-layer surface smoothness and friction. The crystallinity/amorphous can be judged by presence or absence of the points and lines in the diffraction image obtained by RHEED (reflection high-energy electron diffraction) measurement. The amorphousness can also be judged by absence of the sharp peak at the diffraction angle inherent to crystal by X-ray diffraction spectrum measurement.

Various dopants may be added to the surface layer 3 for control of type of conductivity. For example, one or more elements selected from Si, Ge, and Sn may be used for controlling the conductivity of the surface layer to be n-type, while for example, one or more elements selected from Be, Mg, Ca, Zn, and Sr may be used for controlling it to be p-type. Normally, undoped surface layer is mostly n-type, and an element used in controlling it to be p-type may be used for further increase in dark resistance.

Even when the crystallinity/noncrystallinity of the surface layer 3 in the embodiment of the invention is microcrystalline, polycrystalline or amorphous, the layer often contains many bond defects, transition defects, grain boundary defect, and the like in the structure. Thus, hydrogen and/or a halogen element may be added to the surface layer for inactivation of these defects. The hydrogen and the halogen element in the surface layer are incorporated for example into the bond defects, leading to elimination of reactive sites and electrical compensation and thus reducing trapping of diffusion and migration of the carrier in the semiconductor film.

Hereinafter, favorable properties of the surface layer 3 in a composition other than that described above will be described briefly. The surface layer 3 may be amorphous or crystalline as described above, however the surface layer 3 is preferably amorphous for improvement in adhesiveness with the photosensitive layer (or intermediate layer) and the slidability of the photoreceptor surface. The lower layer of the surface layer 3 (photosensitive layer-sided) may also be microcrystalline, and the upper layer (photoreceptor surface sided) be amorphous.

Charges may be injected into the surface layer 3 during charging. In such a case, the charge should be trapped between the surface layer 3 and the photosensitive layer 2. Alternatively, the charge may be trapped on the surface of the surface layer 3. For example, when the photosensitive layer 2 is functionally separated as shown in FIG. 2, if electron is injected into the surface layer 3 by negative charging, the surface layer-sided face of the charge-transporting layer may function to trap the charge or the intermediate layer 5 may function to block charge injection or trap the charge. The same is true when the photoreceptor is positively charged.

The thickness of the surface layer 3 is preferably in the range of 0.1 to 1 μm. A thickness of 0.1 μm or less makes the layer more susceptible to the influence by the photosensitive layer, leading to deterioration in mechanical strength. Alternatively, a thickness of 1 μm or more may lead to rise in the residual electric potential by repeated charging and exposure, strengthening of the mechanical internal stress to the photosensitive layer, and easier separation and cracking.

The surface layer 3 may function also as a charge injection-blocking layer or a charge-injecting layer. In such a case, as described above, it is possible to make the surface layer 3 function as a charge injection-blocking layer or a charge-injecting layer, by adjusting the conductivity of the surface layer film to be n-type or p-type.

When the surface layer 3 functions as a charge-injecting layer, the charge is trapped on the surfaces of the intermediate layer 5 and the photosensitive layer 2 (surface layer-sided face). During negative charging, the n-type surface layer 3 functions as a charge-injecting layer and the p-type surface layer functions as a charge injection-blocking layer. During positive charging, the n-type surface layer 3 functions as a charge injection-blocking layer, while the p-type surface layer as a charge-injecting layer.

A high resistant i-type surface layer film may be formed as the surface layer for retention of the electrostatic latent image.

Hereinafter, the method of forming the surface layer and the intermediate layer in the embodiment of the invention will be described. The surface layer and the intermediate layer may be formed by a known gas-phase deposition method such as plasma CVD (chemical vapor deposition), organometallic gas-phase growth, molecular beam epitaxy, vapor deposition, or sputtering, however use of the organometallic gas-phase growth method is preferable.

It is preferable then to form the surface layer and the intermediate layer of the embodiment of the invention on a photosensitive layer, by converting a nitrogen-containing substance and/or an oxygen-containing substance into active species by an activation unit for activating the nitrogen-containing substance and the oxygen-containing substance into the energy state or excited state needed for reaction and allowing the activated species to react with an inactivated Group 13 element-containing organometallic compound.

It is thus possible to form the surface layer and the intermediate layer having the properties described above as the surface layers of the photoreceptor without thermally damaging the photosensitive layer, even when the contains photosensitive layer contains an organic material. In forming the surface layer and the intermediate layer, the surface of the photosensitive layer may be cleaned previously with plasma.

The surface layer and the intermediate layer are normally formed by supplying each of the gases of a nitrogen-containing substance, an oxygen-containing substance, and a Group 13 element-containing organometallic compound or the vaporized gases thereof into a reaction chamber (film-forming chamber) containing a substrate (a conductive substrate carrying a photosensitive layer formed) and withdrawing the reaction gas out of the reaction chamber. From the viewpoint above, the Group 13 element-containing organometallic compound is preferably introduced to a position downstream of the activation unit for activating the nitrogen- and oxygen-containing substances.

Thus, the nitrogen-containing substance and the oxygen-containing substance activated at a position upstream of the position of the Group 13 element-containing organometallic compound being introduced meet the inactivated Group 13 element-containing organometallic compound at the position downstream of the activation unit, allowing the activated nitrogen-containing substance and/or the oxygen-containing substance to react with it.

Alternatively in forming the surface layer and the intermediate layer in the embodiment of the invention, when the photoreceptor photosensitive layer contains an organic material such as organic charge-generating substance or binder resin, the highest temperature of the substrate surface when the intermediate layer is formed on the photosensitive layer is preferably 100° C. or lower, more preferably 50° C. or lower, and the highest temperature of the substrate surface is preferable as close to normal temperature as possible. A highest temperature of higher than 100° C. may lead, for example, to deformation of the substrate, decomposition of the organic material contained in the photosensitive layer and consequently to deterioration in physical properties.

The intermediate layer and surface layer in the embodiment of the invention may be formed by placing a substrate 14 carrying a photosensitive layer formed on a conductive substrate in the film-forming chamber 10 and forming an intermediate layer and a surface layer continuously by supplying each mixed gas different in composition, or alternatively by forming an intermediate layer, placing it as the substrate 14 a in a film-forming chamber 10 and the forming a surface layer.

As for the film-forming condition, for example when the film is processed by high-frequency discharge, the frequency is preferably in the range of 10 kHz to 50 MHz for preparing a favorable quality film at low temperature. The favorable output depends on the size of the substrate, but is preferably in the range of 0.01 to 0.2 W/cm$^2$ with respect to the surface area of substrate. The rotation frequency of the substrate is preferably 0.1 to 500 rpm.

The conditions for forming the intermediate layer and the surface layer may be the same with each other, but, for example, the intermediate layer may be formed at a relatively lower output for production at low temperature, and the surface layer be formed at high output.

The total thickness of the intermediate layer and the surface layer thus formed is 0.1 μm or more and less than 5 μm, and preferably in the range of 0.5 to 10% with respect to the thickness of the photosensitive layer described below. Fundamentally in photoreceptor, when the photosensitive layer is thicker than the surface region, the surface region is less vulnerable to the distortion by stress.

When the layer thickness is thicker than 10% of the photosensitive layer, the photosensitive layer as a whole is more vulnerable to distortion, and there may be more cracking on the surface region. The residual electric potential of the composite is larger than the sum of its individual residual electric potentials. When the layer thickness is less than 0.5% of the photosensitive layer, the surface region may lead to deterioration in durability and insufficient layer thickness.

The ratio of the layer thicknesses is more preferably in the range of 0.7 to 7%.

—Conductive Substrate—

Hereinafter, details of the conductive substrate and the photosensitive layer constituting the electrophotographic photoreceptor of the invention and details of the undercoat layer formed as needed will be described, taking the case where the electrophotographic photoreceptor of the invention is an organic photoreceptor having functionally separated photosensitive layers as an example.

Examples of the conductive substrates include metal drums of aluminum, copper, iron, stainless steel, zinc, or nickel; composites of a substrate such as sheet, paper, plastic, or glass carrying a deposited metal of aluminum, copper, gold, silver, platinum, palladium, titanium, nickel-chromium, stainless steel, copper-indium, or the like; composites of the substrate carrying a deposited conductive metal compound such as indium oxide and tin oxide; laminates of the substrate with a metal foil; materials prepared by dispersing carbon black, indium oxide, tin oxide-antimony oxide powder, metal powder, copper iodide, or the like in a binder resin, coating the dispersion on the substrate, and treating the resulting film to be conductive; and the like. The conductive substrate may be in any shape: drum, sheet, or plate.

When a metal pipe substrate is used as the conductive substrate, the surface of the metal pipe substrate may be as it is, or the substrate surface may be surface-roughened previously by surface treatment. By such as surface roughening, it is possible to prevent grained irregularity in density caused by the coherent light generated in the photoreceptor when a coherent light source such as laser beam is used as the radiation source. Examples of the methods of surface treatment include mirror surface machining, etching, anodic oxidation, rough machining, centerless abrasion, sand blasting, wet honing and the like.

In particular, as will be described below, use of an aluminum substrate having anodized surface as the conductive substrate is preferable from the viewpoints of improvement in adhesiveness to the photosensitive layer and film-forming property.

Hereinafter, the method of preparing a surface-anodized conductive substrate will be described. First, pure aluminum or an aluminum alloy (for example, aluminum of JIS H4080, alloy No. 1000's, 3000's, or 6000's or its aluminum alloy) is made available as the substrate. It is then anodized. The anodizing is carried out in an acidic solution such as of chromic acid, sulfuric acid, oxalic acid, phosphoric acid, boric acid, or sulfamic acid, however treatment in a sulfuric acid bath is used commonly. The anodizing processing is carried out, for example, under the condition of a sulfuric acid concentration of 10 to 20 weight %, a bath temperature of 5 to 25° C., a current density of 1 to 4 $A/dm^2$, an electrolysis voltage of 5 to 30 V, and a treatment period of approximately 5 to 60 minutes, however the condition is not limited thereto.

The anodized film thus formed on the aluminum substrate is porous and more insulative; the surface is very unstable; and thus, the physical properties change easily over time after film formation. For prevention of the change in physical properties, the pores in the anodized film are sealed additionally. The sealing methods include a method of immersing the anodized film in an aqueous solution containing nickel fluoride or nickel acetate, a method of immersing the anodized film in boiling water, a method of treating it with pressurized steam, and the like. Among these methods, the method of immersing the film in an aqueous solution containing nickel acetate is used most frequently.

The metal salt deposited during sealing remains on the surface of the anodized film thus sealed in an excessive amount. Such a metal salt or the like remaining on the anodized film on substrate frequently exerts an adverse effect on the film formed on the anodized film and also leaves low-resistance components thereon, and thus, may cause higher background soil when an image is formed on a photoreceptor using the substrate.

For that reason, the anodized film is cleaned after sealing for removal of the metal salt deposited during sealing. The substrate may be washed with purified water once, but is preferably washed repeatedly in multiple steps. The washing water used then in the final cleaning step is washing water purified (deionized) as much as possible. The substrate is more preferably cleaned physically with a contact material such as brush in one of the multiple cleaning steps.

The thickness of the anodized film having a conductive substrate surface thus formed is preferably in the range of approximately 3 to 15 μm. A so-called barrier layer is present along the porous surface of the porous anodized film on the anodized film. The thickness of the barrier layer is preferably in the range of 1 to 100 nm in the photoreceptor for use in the invention. It is thus possible to obtain an anodized conductive substrate.

The conductive substrate thus obtained has a high carrier-blocking anodized film formed on the substrate by anodization. Thus, it is possible to prevent point defects (black spots, background soil) generated when an image is reversely, developed (negative-positive development) by placing the photoreceptor of the conductive substrate in an image-forming apparatus and also, to prevent the current leak from the contact charger, which may occur frequently during contact charging. It is also possible to prevent the change in physical properties over time after preparation of anodized film, by sealing the anodized film. By cleaning the conductive substrate after sealing it is also possible to remove the metal salts and others deposited on the conductive substrate surface during sealing and to prevent background soil sufficiently, when an image is formed in an image-forming apparatus having the photoreceptor prepared by using the conductive substrate.

—Undercoat Layer—

Hereinafter, the undercoat layer will be described. Examples of the materials for the undercoat layer include polymer resin compounds including acetal resins such as polyvinylbutyral, polyvinylalcohol resins, casein, polyamide resins, cellulosic resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, melamine resins and the like; and organometallic compounds containing zirconium, titanium, aluminum, manganese, silicon or other atom; and the like.

These compounds may be used alone or as a mixture or polycondensate of multiple compounds. Among them, organometallic compounds containing zirconium or silicon, which are lower in residual electric potential and resistant to the electric potential change caused by environment and to the change in electric potential by repeated use, are used favorably. The organometallic compounds may be used alone or in combination of two or more, or as mixed with a binder resin described above.

Examples of the organic silicon compounds (silicon atom-containing organometallic compounds) include vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethylmethoxysilane, N,N-bis(β-hydroxyethyl)-γ-aminopropyl triethoxysilane, γ-chloropropyltrimethoxysilane, and the like. Among them, silane-coupling agents such as vinyltriethoxysilane, vinyltris(2-methoxyethoxysilane), 3-methacryloxypropyltrimethoxysilane, 3-glycidoxypropyltrimethoxysilane, 2-(3,4-epoxycyclohexyl)ethyltrimethoxysilane, N-2-(aminoethyl)-3-aminopropyltrimethoxysilane, N-2-(aminoethyl)-3-aminopropylmethyldimethoxysilane, 3-aminopropyltriethoxysilane, N-phenyl-3-aminopropyltrimethoxysilane, 3-mercaptopropyltrimethoxysilane, and 3-chloropropyltrimethoxysilane are used favorably.

Examples of the organic zirconium compounds (zirconium-containing organometallic compounds) include zirconium butoxide, zirconium ethylacetoacetate, zirconium triethanolamine, zirconium acetylacetonate butoxide, zirconium ethylacetoacetate butoxide, zirconium acetate, zirconium oxalate, zirconium lactate, zirconium phosphonate, zirconium octanoate, zirconium naphthenate, zirconium laurate, zirconium stearate, zirconium isostearate, zirconium methacrylate butoxide, zirconium stearate butoxide, zirconium isostearate butoxide, and the like.

Examples of the organic titanium compounds (titanium-containing organometallic compounds) include tetraisopropyl titanate, tetra-n-butyl titanate, butyl titanate dimer, tetra (2-ethylhexyl) titanate, titanium acetylacetonate, polytitanium acetylacetonate, titanium octyleneglycolate, titanium lactate ammonium salt, titanium lactate, titanium lactate ethylester, titanium triethanol aminate, polyhydroxytitanium stearate, and the like.

Examples of the organic aluminum compounds (aluminum-containing organometallic compounds) include aluminum isopropylate, monobutoxyaluminum diisopropylate, aluminum butyrate, aluminum diethyl acetoacetate diisopropylate, aluminum tris(ethylacetoacetate), and the like.

Examples of the solvents for use in preparing an undercoat layer-coating solution for forming an undercoat layer include known organic solvents including aromatic hydrocarbon-based solvents such as toluene and chlorobenzene; aliphatic alcohol solvents such as methanol, ethanol, n-propanol, isopropanol, and n-butanol; ketone-based solvents such as acetone, cyclohexanone, and 2-butanone; halogenated aliphatic hydrocarbon solvents such as methylene chloride, chloroform, and ethylene chloride; cyclic or straight-chain ether-based solvents such as tetrahydrofuran, dioxane, ethylene glycol, and diethylether; ester-based solvents such as methyl acetate, ethyl acetate, and n-butyl acetate, and the like. These solvents may be used alone or in combination of two or more. The solvent for use when two or more solvents are used as mixed may be any solvent if it dissolves the binder resin as a mixed solvent.

The undercoat layer is formed first by preparing an undercoat layer-coating solution by dispersing and mixing undercoat layer-coating agents and a solvent and coating the solution on a conductive substrate surface. The methods for use in applying the undercoat layer-coating solution include ordinary methods including dip coating, ring coating, wire bar coating, spray coating, blade coating, knife coating, curtain coating, and the like. The thickness of the undercoat layer when formed is preferably in the range of 0.1 to 3 μm. It is possible to prevent the increase in electric potential by charging a repetition photoirradiation without strengthening electrical barrier excessively, by adjusting the thickness of the undercoat layer in the range above.

It is possible to improve the wettability when a layer is formed on the undercoat layer by coating and make the undercoat layer function as an electrical blocking layer sufficiently, by forming an undercoat layer on the conductive substrate.

The surface roughness of the undercoat layer thus formed may be so adjusted that the surface has a roughness in the range of 1/(4n) time to 1 time of the laser wavelength λ of the irradiation laser used (wherein, n represents the refractive index of the layer formed on the external surface side of the undercoat layer). The surface roughness is adjusted by adding resin particles into the undercoat layer-coating solution. It is possible to prevent interference fringe images by laser beam source more efficiently, by using a photoreceptor prepared by controlling the surface roughness of the undercoat layer in image-forming apparatus.

Examples of the resin particles include silicone resin particles, crosslinked PMMA resin particles, and the like. The undercoat layer surface may be polished for adjustment of the surface roughness. The polishing methods include puff polishing, sand blasting, wet honing, grinding treatment, and the like. In the photoreceptor used in positive-charging image-forming apparatus, the incident laser beam is absorbed in the almost surface of the photoreceptor and scattered in the photosensitive layer, and thus, there is not much need for adjustment of the surface roughness of the undercoat layer.

Various additives are added favorably to the undercoat layer-coating solution for improvement in electric properties, environmental stability, and image quality. Examples of the additives include known materials including electron transporting substances, for example, quinone-based compounds such as chloranil, bromoanil and anthraquinone, tetracyanoquinodimethane-based compound, fluorenone compounds such as 2,4,7-trinitro fluorenone and 2,4,5,7-tetranitro-9-fluorenone, oxadiazole-based compounds such as 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)-1,3,4-oxadiazole, xanthone-based compounds, thiophene compound and diphenoquinone compounds such as 3,3',5,5'-tetra-t-butyl diphenoquinone; electron transporting pigments such as polycyclic condensation and azo-based pigments; zirconium chelate compounds, titanium chelate compounds, aluminum chelate compounds, titanium alkoxide compounds, organic titanium compounds, and silane-coupling agents.

Specific examples of the silane-coupling agents for use include, but are not limited to, silane-coupling agents such as vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethylmethoxysilane, N,N-bis(β-hydroxyethyl)-γ-aminopropyltriethoxysilane, and γ-chloropropyltrimethoxysilane.

Specific examples of the zirconium chelate compounds include, zirconium butoxide, zirconium ethyl acetoacetate, zirconium triethanolamine, zirconium acetylacetonate butoxide, zirconium ethylacetoacetate butoxide, zirconium acetate, zirconium oxalate, zirconium lactate, zirconium phosphonate, zirconium octanoate, zirconium naphthenate, zirconium laurate, zirconium stearate, zirconium isostearate, zirconium methacrylate butoxide, zirconium stearate butoxide, zirconium isostearate butoxide, and the like.

Specific examples of the titanium chelate compounds include, tetraisopropyl titanate, tetra-n-butyl titanate, butyl titanate dimer, tetra(2-ethylhexyl) titanate, titanium acetylacetonate, polytitanium acetylacetonate, titanium octyleneglycolate, titanium lactate ammonium salt, titanium lactate, titanium lactate ethylester, titanium triethanol aminate, polyhydroxytitanium stearate, and the like.

Specific examples of the aluminum chelate compounds include, aluminum isopropylate, monobutoxyaluminum diisopropylate, aluminum butyrate, aluminum diethyl acetoacetate diisopropylate, aluminum tris(ethyl acetoacetate), and the like.

These additives may be used alone or as a mixture or polycondensate of multiple compounds.

The undercoat layer-coating solution described above preferably contains at least one electron-accepting substance.

Specific examples of the electron-accepting substances include, succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, p-nitrobenzoic acid, phthalic acid, and the like. Among them, fluorenone-based compounds, quinone-based compounds, benzene derivatives having an electron-withdrawing substituent such as Cl, CN, or $NO_2$ are used more favorably. It is thus possible to improve the photosensitivity in the photosensitive layer, reduce the residual electric potential, reduce degradation of photosensitivity after repeated use, and prevent the irregularity in density of the toner image formed in an image-forming apparatus having a photoreceptor containing the electron-accepting substance in the undercoat layer sufficiently.

The following dispersed undercoat layer-coating agent may be used favorably instead of the undercoat layer-coating agent described above. It is thus possible to prevent accumulation of residual charge and thicken the undercoat layer further by adjusting the resistance of the undercoat layer properly, thus to improve the leakage resistance of photoreceptor, and in particular to prevent leakage during contact charging.

Examples of the dispersed undercoat layer-coating agents include binder resin dispersions of powders, for example, of metals such as aluminum, copper, nickel, and silver; conductive metal oxides such as antimony oxide, indium oxide, tin oxide, and zinc oxide; conductive substances such as carbon fiber, carbon black, and graphite powder, and the like. Metal oxide fine particles having an average primary particle diameter of 0.5 μm or less are used favorably as the conductive metal oxide. Particles having an excessively large average primary particle diameter may lead to generation of local conductive path, often causing electric leakage and consequently high background soil and large electric leakage from the charger. The undercoat layer is preferably adjusted to a suitable resistance for improvement in leak resistance. Thus, the metal oxide fine particles described above preferably have a powder resistance of approximately $10^2$ to $10^{11}$ Ω·cm.

A powder resistance below the range above may lead to decline of the resistance of the metal oxide fine particles and insufficient leak resistance, while that above the range to increase in the residual electric potential. Accordingly among them, fine particles of metal oxides having a resistance in the range above such as tin oxide, titanium oxide, and zinc oxide are used more favorably. Two or more kinds of metal oxide fine particles may be used as mixed. It is also possible to control the resistance of the metal oxide fine particles by surface treatment thereof with a coupling agent. The coupling agent for use is the same as the material for the undercoat layer-coating solution described above. In addition, these coupling agents may be used in combination of two or more.

Any known method may be used for surface treatment of the metal oxide fine particles, and both dry and wet methods are used favorably.

First in the dry method, water absorbed on the surface of the metal oxide fine particles is removed by heating. Removal of the surface adsorbed water allows uniform adsorption of the coupling agent on the metal oxide fine particle surface. Then, the metal oxide fine particles are treated with a coupling agent uniformly, as the coupling agent is added dropwise, directly or as dissolved in an organic solvent or water, or sprayed together with dry air or nitrogen gas, and the mixture is agitated in a mixer having a large shearing force. The coupling agent is preferably added or sprayed at a temperature of 50° C. or higher. After addition or spraying of the coupling agent, the particles are preferably baked at 100° C. or higher. The baking leads to hardening of the coupling agent and also tight adhesion to the metal oxide fine particle in chemical reaction. The particles may be baked at any temperature for any period, if desired electrophotographic characteristics are obtained.

In the wet method, the surface-adsorbed water on the metal oxide fine particle is first removed as in the dry method. The surface-adsorbed water may be removed, for example, by drying under heat as in the dry method, stirring under heat in a solvent for surface treatment, azeotropic distillation of the solvent, or the like. The metal oxide fine particles are then treated with a coupling agent uniformly, by stirring the particles stirred in a solvent and dispersing the particles by using ultrasonic wave in a sand mill, attriter, ball mill or the like, adding a coupling agent solution thereto dropwise, agitating and dispersing the mixture, and then, removing the solvent. After solvent removal, the mixture is baked additionally at 100° C. or higher. The particles may be baked at any temperature for any period, if desired electrophotographic characteristics are obtained.

The surface-treating agent should be added to the metal oxide fine particles in an amount sufficient for giving desired electrophotographic characteristics. The electrophotographic characteristics are influenced by the amount of the surface-treating agent remaining on the metal oxide fine particles after surface treatment. The adhesion amount of the silane-coupling agent is determined on the basis of the Si intensity (due to Si in silane-coupling agent) as determined by fluorescent X-ray analysis and the intensity of the main metal element in the metal oxide used. The Si intensity, as determined by the fluorescent X-ray analysis, is preferably in the range of $1.0\times10^{-5}$ to $1.0\times10^{-3}$ times of the intensity of the main metal element in the metal oxide used. An intensity below the range often leads to image defects such as high background soil, while an intensity above the range may lead to deterioration in density due to increase in residual electric potential.

Examples of the binder resins contained in the dispersed undercoat layer-coating agent include known polymer resin compounds such as acetal resins such as polyvinylbutyral, polyvinylalcohol resins, casein, polyamide resins, cellulosic resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol resins, phenol-formaldehyde resins, melamine resins, and urethane resins; and conductive resins such as electric charge-transporting resins containing an electric charge-transporting group and polyaniline; and the like.

Among them, resins insoluble in the coating solution for the layer formed on the undercoat layer are used favorably, and in particular, phenol resins, phenol-formaldehyde resins, melamine resins, urethane resins, epoxy resins and the like are used favorably. The ratio of the metal oxide fine particles to the binder resin in the dispersed undercoat layer-coating solution may be determined arbitrarily in the range allowing desirable photoreceptor characteristics.

The metal oxide fine particles surface-treated by the method described above is dispersed in the binder resin, for example, by a method of using a medium dispersing machine such as ball mill, vibration ball mill, attriter, sand mill, or horizontal sand mill or a mediumless dispersing machine such as agitation, ultrasonic dispersing machine, roll mill, or high-pressure homogenizer. The high-pressure homogenizers include a collision-type homogenizer further dispersing the crude dispersion by liquid-liquid collision or liquid-wall collision under high pressure and a penetration-type homogenizer dispersing liquid by passage through fine channels under high pressure, and the like.

The undercoat layer is formed with the dispersed undercoat layer-coating agent, according to a method similar to that of forming an undercoat layer by using an undercoat layer-coating agent described above.

—Photosensitive Layer: Charge-Transporting Layer—

Hereinafter, the charge-transporting layer and the charge-generating layer in photosensitive layer will be described in this order. Examples of the charge-transporting materials for use in the charge-transporting layer include the followings: oxadiazole derivatives such as 2,5-bis(p-diethylaminophenyl)-1,3,4-oxadiazole; pyrazoline derivatives such as 1,3,5-triphenyl-pyrazoline, 1-[pyridyl-(2)]-3-(p-diethylaminostyryl)-5-(p-diethylaminostyryl)pyrazoline; aromatic tertiary amine compounds such as triphenylamine, tri(p-methyl)phenylamine, N,N-bis(3,4-dimethylphenyl)biphenyl-4-amine, dibenzylaniline, and 9,9-dimethyl-N,N-di(p-tolyl) fluorenone-2-amine; aromatic tertiary diamine compounds such as N,N'-diphenyl-N,N'-bis(3-methylphenyl)-[1,1-biphenyl]-4,4'-diamine; 1,2,4-triazine derivatives such as 3-(4'-dimethylaminophenyl)-5,6-di-(4'-methoxyphenyl)-1,2,4-triazine; hydrazone derivatives such as 4-diethylaminobenzaldehyde-1,1-diphenylhydrazone, 4-diphenylaminobenzaldehyde-1,1-diphenyl hydrazone, [p-(diethylamino)phenyl] (1-naphthyl)phenyl hydrazone, 1-pyrene diphenylhydrazone, 9-ethyl-3-[(2 methyl-1-indolynylimino)methyl]carbazole, 4-(2-methyl-1-indolynyliminomethyl)triphenylamine, 9-methyl-3-carbazole diphenylhydrazone, 1,1-di-(4,4'-methoxyphenyl)acrylic aldehyde diphenylhydrazone, β,β-bis(methoxyphenyl)vinyl diphenylhydrazone; quinazoline derivatives such as 2-phenyl-4-styryl-quinazoline; benzofuran derivatives such as 6-hydroxy-2,3-di(p-methoxyphenyl)-benzofuran; α-stilbene derivatives such as p-(2,2-diphenylvinyl)-N,N-diphenylaniline; enamine derivatives; carbazole derivatives such as N-ethylcarbazole; hole-transporting materials such as poly-N-vinylcarbazole and the derivatives thereof, and the like. Also included are polymers having the group consisting of the compound above on the main or side chain, and these charge-transporting materials may be used alone or in combination of two or more.

Any resin may be used as the binder resin for use in the charge-transporting layer, however the binder resin is preferably a resin having a suitable strength and a compatibility with the charge-transporting material.

Examples of the binder resins include various polycarbonate resins such as of bisphenol A, bisphenol Z, bisphenol C, and bisphenol TP and the copolymers thereof, polyarylate resins and the copolymers thereof, polyester resins, methacrylic resins, acrylic resins, polyvinyl chloride resins, polyvinylidene chloride resins, polystyrene resins, polyvinyl acetate resins, styrene-butadiene resin copolymers, vinyl chloride-vinyl acetate resin copolymers, vinyl chloride-vinyl acetate-maleic anhydride resin copolymers, silicone resins, silicone alkyd resins, phenol-formaldehyde resins, styrene-acryl resin copolymers, styrene-alkyd resins, poly-N-vinylcarbazole resins, polyvinylbutyral resins, polyphenylene ether resins and the like. These resins may be used alone or in combination of two or more.

The molecular weight of the binder resin for use in the charge-transporting layer may be selected properly according to the film-forming conditions such as thickness of the photosensitive layer and solvent, however normally, the viscosity-average molecular weight is preferably in the range of 3,000 to 300,000, more preferably in the range of 20,000 to 200,000.

The charge-transporting layer can be formed by coating and drying a solution containing the charge-transporting material and the binder resin dissolved in a suitable solvent. Examples of the solvents for use in the solution for forming the charge-transporting layer include aromatic hydrocarbons such as benzene, toluene, and chlorobenzene; ketones such as acetone and 2-butanone; halogenated aliphatic hydrocarbons such as methylene chloride, chloroform, and ethylene chloride; cyclic or straight-chain ethers such as tetrahydrofuran, dioxane, ethylene glycol, and diethylether; the mixed solvent thereof; and the like. The blending ratio of the charge-transporting material to the binder resin is preferably in the range of 10:1 to 1:5. The thickness of the charge-transporting layer is generally, preferably in the range of 5 to 50 μm, more preferably in the range of 10 to 40 μm.

The charge-transporting layer and/or the charge-generating layer described below may contain additives such as antioxidant, photostabilizer, and heat stabilizer additionally, for prevention of degradation of the photoreceptor by the ozone and oxidative gases generated in the image-forming apparatus, heat, or light.

Examples of the antioxidants include hindered phenols, hindered amines, p-phenylenediamine, arylalkanes, hydroquinone, spirochromane, spiroindanone or the derivatives thereof, organic sulfur compounds, organic phosphorus compounds, and the like.

Specific examples of the antioxidant compounds include phenol-based antioxidants such as 2,6-di-t-butyl-4-methylphenol, styrenated phenol, n-octadecyl-3-(3',5'-di-t-butyl-4'-hydroxyphenyl)-propionate, 2,2'-methylene-bis-(4-methyl-6-t-butylphenol), 2-t-butyl-6-(3'-t-butyl-5'-methyl-2'-hydroxybenzyl)-4-methylphenyl acrylate, 4,4'-butylidene-bis-(3-methyl-6-t-butyl-phenol), 4,4'-thio-bis-(3-methyl-6-t-butylphenol), 1,3,5-tris(4-t-butyl-3-hydroxy-2,6-dimethylbenzyl)isocyanurate, tetrakis-[methylene-3-(3',5'-di-t-butyl-4'-hydroxy-phenyl)propionate]-methane, 3,9-bis [2-[3-(3-t-butyl-4-hydroxy-5-methylphenyl)propionyloxy]-1,1-dimethylethyl]-2,4,8,10-tetraoxaspiro[5,5]undecane, stearyl 3-(3',5'-di-t-butyl-4'-hydroxyphenyl)propionate and the like; hindered amine compounds such as bis(2,2,6,6-tetramethyl-4-pyperidyl)sebacate, bis(1,2,2,6,6-pentamethyl-4-pyperidyl)sebacate, 1-[2-[3-(3,5-di-t-butyl-4-hydroxyphenyl)propionyloxy]ethyl]-4-[3-(3,5-di-t-butyl-4-hydroxyphenyl)propionyloxy]-2,2,6,6-tetramethylpiperidine, 8-benzyl-7,7,9,9-tetramethyl-3-octyl-1,3,8-triazaspiro[4,5]undecane-2,4-dione, 4-benzoyloxy-2,2,6,6-tetramethylpiperidine, dimethyl succinate-1-(2-hydroxyethyl)-4-hydroxy-2,2,6,6-tetramethylpiperidine polycondensate, poly[{6-(1,1,3,3-tetramethylbutyl)imino-1,3,5-triazin-2,4-diyl}{(2,2,6,6-tetramethyl-4-pyperidyl) imino}hexamethylene {(2,3,6,6-tetramethyl-4-pyperidyl) imino}], 2-(3,5-di-t-butyl-4-hydroxybenzyl)-2-n-butyl bis malonic acid bis(1,2,2,6,6-pentamethyl-4-pyperidyl), N,N'-bis(3-aminopropyl)ethylenediamine-2,4-bis [N-butyl-N-(1,2,2,6,6-pentamethyl-4 piperidyl)amino]-6-chloro-1,3,5-triazine condensate, and the like; organic sulfur-based antioxidants such as dilauryl-3,3'-thiodipropionate, dimyristyl-3,3'-thiodipropionate, distearyl-3,3'-thiodipropionate, pentaerythritol-tetrakis-(β-lauryl-thiopropionate), ditridecyl-3,3'-thiodipropionate, 2-mercaptobenzimidazole, and the like; and organic phosphorus-based antioxidants such as tris-nonylphenyl phosphite, triphenyl phosphite, tris(2,4-di-t-butylphenyl)-phosphite, and the like.

The organic sulfur- and phosphorus-based antioxidants are called secondary antioxidants, and improve anti-oxidative effect synergistically in combination with a phenol- or amine-based primary antioxidant.

The photostabilizers include, for example, derivatives of benzophenone, benzotriazole, dithiocarbamate, and tetramethylpiperidine, and the like.

Examples of the benzophenone-based photostabilizers include 2-hydroxy-4-methoxybenzophenone, 2-hydroxy-4-octoxybenzophenone, 2,2'-di-hydroxy-4-methoxybenzophenone, and the like.

Examples of the benzotriazole-based photostabilizers include 2-(2'-hydroxy-5'-methylphenyl)-benzotriazole, 2-[2'-hydroxy-3'-(3",4",5",6"-tetrahydrophthalimide-methyl)-5'-methylphenyl]-benzotriazole, 2-(2'-hydroxy-3'-t-butyl-5'-methylphenyl)-5-chlorobenzotriazole, 2-(2'-hydroxy-3'-t-butyl-5'-methylphenyl)-5-chlorobenzotriazole, 2-(2'-hydroxy-3',5'-t-butylphenyl)-benzotriazole, 2-(2'-hydroxy-5'-t-octylphenyl]-benzotriazole, 2-(2'-hydroxy-3',5'-di-t-amylphenyl)-benzotriazole, and the like. Examples of other photostabilizers include 2,4-di-t-butylphenyl-3',5'-di-t-butyl-4'-hydroxybenzoate, nickel dibutyl-dithiocarbamate, and the like.

The charge-transporting layer can be formed by coating and drying a solution containing the charge-transporting material and the binder resin described above dissolved in a suitable solvent. Examples of the solvents used for preparing the charge-transporting layer-coating solution include aromatic hydrocarbons such as benzene, toluene, and chlorobenzene; ketones such as acetone and 2-butanone; halogenated aliphatic hydrocarbons such as methylene chloride, chloroform, and ethylene chloride; cyclic or straight-chain ethers such as tetrahydrofuran, dioxane, ethylene glycol, and diethylether; and the like, or the mixed solvents thereof.

A silicone oil, a leveling agent for improvement in the smoothness of the coated film, may be added to the charge-transporting layer-coating solution in a trace amount.

The blending ratio of the charge-transporting material to the binder resin is preferably 10:1 to 1:5 by weight. The thickness of the charge-transporting layer is generally, preferably in the range of 5 to 50 μm, more preferably in the range of 10 to 30 μm.

The charge-transporting layer-coating solution may be coated by dip coating, ring coating, spray coating, bead coating, blade coating, roller coating, knife coating, curtain coating, or the like, according to the shape and application of the photoreceptor. The coated film is preferably dried first at room temperature and then under heat. The coated film is preferably dried in a temperature range of 30° C. to 200° C. for a period in the range of 5 minutes to 2 hours.

—Photosensitive Layer: Charge-Generating Layer—

The charge-generating layer is formed by depositing a charge-generating substance by vacuum deposition or by coating a solution thereof containing an organic solvent and a binder resin additionally.

Examples of the charge-generating substances include selenium compounds such as amorphous selenium, crystalline selenium, selenium-tellurium alloy, selenium-arsenic alloy, and others; inorganic photoconductors such as selenium alloy, zinc oxide, and titanium oxide or those sensitizable with a colorant; various phthalocyanine compounds such as metal free phthalocyanine, titanyl phthalocyanine, copper phthalocyanine, tin phthalocyanine, and gallium phthalocyanine; various organic pigments such as squarilium-based pigment, anthanthrone-based pigment, perylene-based pigment, azo-based pigment, anthraquinone-based pigment, pyrene-based pigment, pyrylium salt, and thiapyrylium salt; and dyes.

These organic pigments generally have several crystal forms, and in particular, phthalocyanine compounds have many crystal forms including α and β, however any crystal form may be used, if the pigment gives sensitivity and other characteristics suitable for application.

Among the charge-generating substance described above, phthalocyanine compounds are preferable. In such a case, when light is irradiated on the photosensitive layer, the phthalocyanine compound contained in the photosensitive layer absorbs the photon and generates a carrier. The phthalocyanine compound has a high quantum efficiency then, absorbing the photon and efficiently generating the carrier.

Among the phthalocyanine compounds above, more preferable are the following phthalocyanines (1) to (3):

(1) hydroxygallium phthalocyanine in the crystal form having diffraction peaks at least at Bragg angles (2θ±0.2°) of 7.6°, 10.0°, 25.2°, and 28.0° in the X-ray diffraction spectrum obtained by using CuKα ray as the charge-generating substance, (2) chlorogallium phthalocyanine in the crystal form having diffraction peaks at least at Bragg angles (2θ±0.2°) of 7.3°, 16.5°, 25.4°, and 28.1°in the X-ray diffraction spectrum obtained by using CuKα ray as the charge-generating substance, and (3) titanyl phthalocyanine in the crystal form having diffraction peaks at least at Bragg angles (2θ±0.2°) of 9.5°, 24.2°, and 27.3° in the X-ray diffraction spectrum obtained by using CuKα ray as the charge-generating substance, These phthalocyanine compounds are particularly superior in photosensitivity and also in stability of the photosensitivity, and thus, a photoreceptor having a photosensitive layer containing the phthalocyanine compound is favorably used as a photoreceptor for the color image-forming apparatus demanding high-speed image formation and favorable repetition reproducibility.

The peak intensity and the diffraction angle thereof may deviate slightly from the value above according to the crystal shape and measuring method, however crystal forms having fundamentally the same X-ray diffraction pattern may be regarded as the same.

The binder resins for use in the charge-generating layer include the followings: polycarbonate resins such as of bisphenol A or bisphenol Z and the copolymers thereof, polyarylate resins, polyester resins, methacrylic resins, acrylic resins, polyvinyl chloride resins, polystyrene resins, polyvinyl acetate resins, styrene-butadiene resin copolymers, vinylidene chloride-acrylonitrile resin copolymers, vinyl chloride-vinyl acetate-maleic anhydride resins, silicone resins, silicon-alkyd resins, phenol-formaldehyde resins, styrene-alkyd resins, poly-N-vinylcarbazole, and the like.

These binder resins may be used alone or in combination of two or more. The blending ratio of the charge-generating substance to the binder resin (charge-generating substance: binder resin) is preferably in the range of 10:1 to 1:10 by weight. The thickness of the charge-generating layer is generally, preferably in the range of 0.01 to 5 μm, more preferably in the range of 0.05 to 2.0 μm.

The charge-generating layer may contain at least one electron-accepting substance, for example for improvement in sensitivity, reduction in residual electric potential, and prevention of fatigue after repeated use. Examples of the electron-accepting substance for use in the charge-generating layer include succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, p-nitrobenzoic acid, and phthalic acid. Among them, fluorenone-based compounds, quinone-based compounds and benzene derivatives having an electron-withdrawing substituent group such as Cl, CN, or $NO_2$ are particularly preferable.

The charge-generating substance can be dispersed in resin, for example, by using a roll mill, ball mill, vibration ball mill, attriter, dyno mill, sand mill, colloid mill, or the like.

Examples of the solvents for use in the coating solution for forming the charge-generating layer include known organic solvents, for example, aromatic hydrocarbon-based solvents such as toluene and chlorobenzene; aliphatic alcohol-based solvents such as methanol, ethanol, n-propanol, iso-propanol, and n-butanol; ketone-based solvents such as acetone, cyclohexanone, and 2-butanone; halogenated aliphatic hydrocarbon solvents such as methylene chloride, chloroform, and ethylene chloride; cyclic or straight-chain ether-based solvents such as tetrahydrofuran, dioxane; ethylene glycol, and diethylether; ester-based solvents such as methyl acetate, ethyl acetate, and n-butyl acetate; and the like.

These solvent may be used alone or as a mixture of two or more. When two or more solvents are used as mixed, any solvent may be used if it can dissolve the binder resin as a mixed solvent. However, when the photosensitive layer has a configuration in which a charge-transporting layer and a charge-generating layer are formed on the conductive substrate side in this order, if a charge-generating layer is formed by an application method easily dissolving the lower layer such as dip coating, use of a solvent that hardly dissolves the lower layer such as charge-transporting layer is preferable. If the charge-generating layer is formed by spray coating or ring coating, which is relatively less erosive to the lower layer, the solvent may be selected from a wider range of solvents.

(Process Cartridge and Image-Forming Apparatus)

Hereinafter, the process cartridge and the image-forming apparatus employing the photoreceptor of the invention will be described.

The process cartridge of the invention is not particularly limited, if it employs the photoreceptor of the invention, but specifically, preferably a system having the photoreceptor of the invention and at least one means selected from the group consisting of an charging unit for charging the photoreceptor surface, a developing unit for forming a toner image on the photoreceptor surface with a toner-containing developer, a cleaning unit for removing the toner remaining on the photoreceptor surface, and an antistatic unit for erasing the charge on the photoreceptor surface, which is removable from the main image-forming apparatus.

The image-forming apparatus of the invention is not particularly limited, if it employs the photoreceptor of the invention, and specifically, preferably a system in a configuration including the photoreceptor of the invention, an charging unit for charging the photoreceptor surface, a light-irradiation unit for forming an electrostatic latent image by photoirradiating the photoreceptor surface charged by the charging unit, a developing unit for forming a toner image by developing the electrostatic latent image with a toner-containing developer, and a transfer unit for transferring the toner image onto a recording medium. The image-forming apparatus of the invention may be a so-called tandem apparatus having multiple photoreceptors respectively corresponding to the toners in various colors, and, in such a case, all photoreceptors are preferably the photoreceptors of the invention. The toner image may be transferred by an intermediate transfer method of using an intermediate transfer belt.

Figure 6:
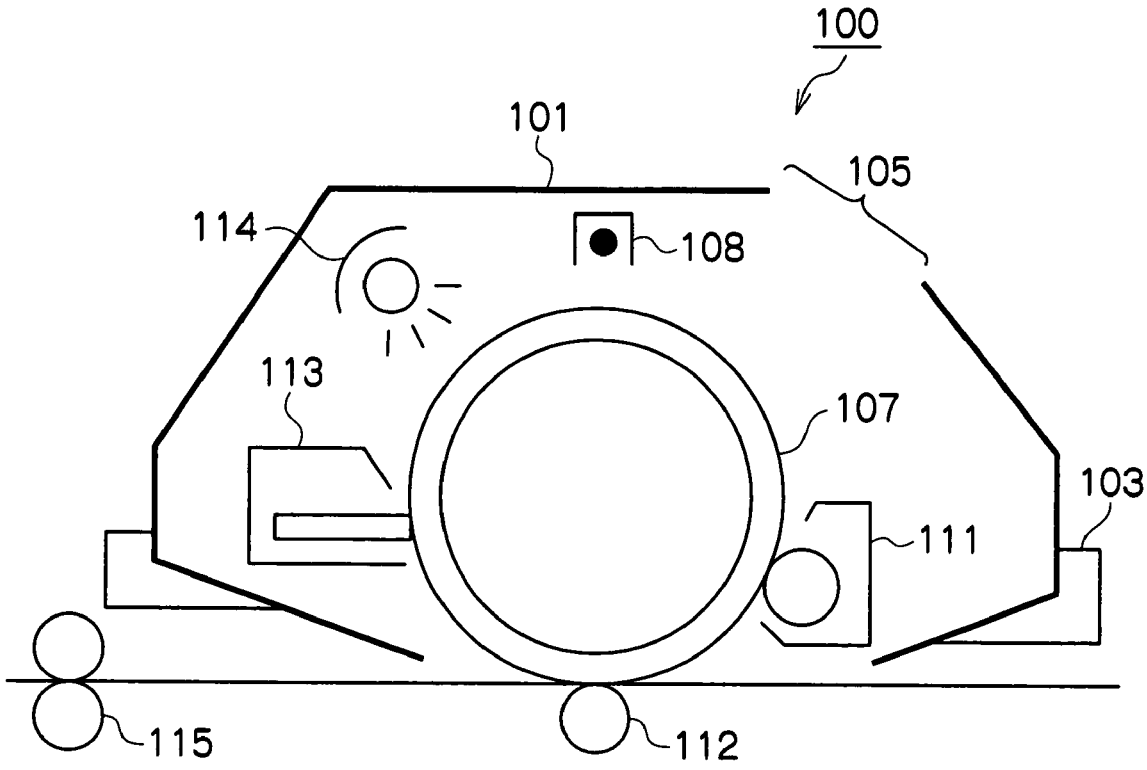
FIG. 6 is a schematic configuration view illustrating an example of the process cartridge of the invention.

FIG. 6 is a schematic view illustrating the configuration of a favorable embodiment of the process cartridge of the invention. The process cartridge 100 is an integrated system having an electrophotographic photoreceptor 107, an charging unit 108, a developing unit 111, a cleaning unit 113, and an opening for photoirradiation 105, an erasing unit 114 fixed on a case 101, and a fixing rail 103. The process cartridge 100, which is removable from the main image-forming apparatus containing a transfer unit 112, a fixing unit 115, and other components not shown in the Figure, constitutes the image-forming apparatus, together with the main electrophotographic system.

Figure 7:
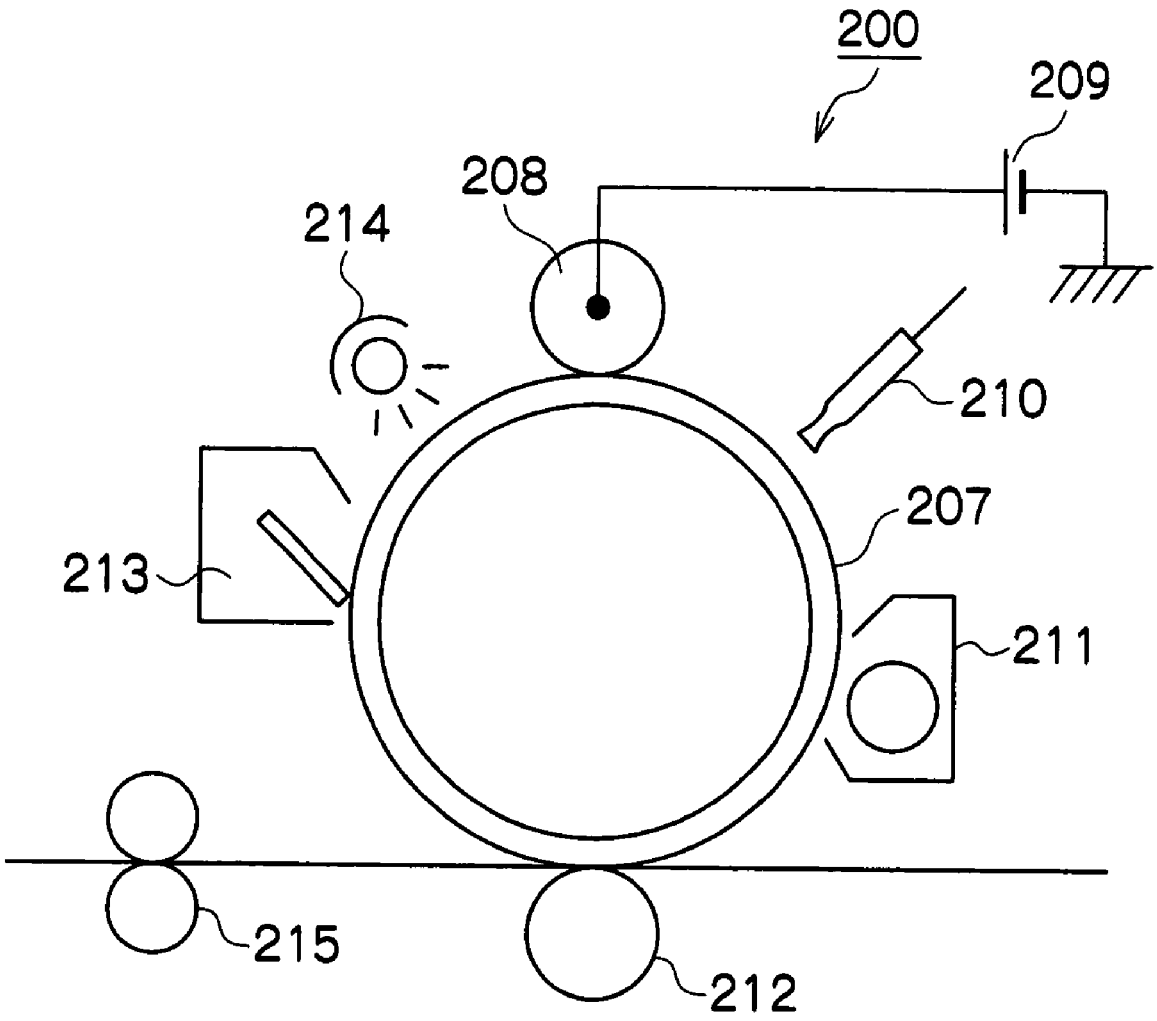
FIG. 7 is a schematic configuration view illustrating an example of the image-forming apparatus of the invention.

FIG. 7 is a schematic view illustrating the basic configuration of an embodiment of the image-forming apparatus of the invention. The image-forming apparatus 200 shown in FIG. 7 has an electrophotographic photoreceptor 207, an charging unit 208 of charging the electrophotographic photoreceptor 207 in contact, a power source 209 in contact with the charging unit 208, a light-irradiation unit 210 of photoirradiating the electrophotographic photoreceptor 207 charged by the charging unit 208, a developing unit 211 of developing the region irradiated by the light-irradiation unit 210, a transfer unit 212 of transferring the image developed on the electrophotographic photoreceptor 207 by the developing unit 211, a cleaning device 213, an erasing unit 214, and a fixing unit 215.

The photoreceptor cleaning unit in the process cartridge or the image-forming apparatus of the invention is not particularly limited, but preferably a cleaning blade. The cleaning blade damages the photoreceptor surface and facilitates abrasion more than other cleaning units. However, because the photoreceptor of the invention is used in the process cartridge and the image-forming apparatus of the invention, it is possible to reduce damaging and abrasion of the photoreceptor surface for an extended period of time.

EXAMPLES

Hereinafter, the invention will be described specifically with reference to Examples, however it should be understood that the invention is not limited to these Examples.

A gas flow rate "sccm" in Examples and Comparative Examples means the gas flow rate at 1 atm (atmospheric pressure, 1,013 hPa) and 0° C.

Example 1

First, an undercoat layer, a charge-generating layer, and a charge-transporting layer are formed on an Al substrate in this order in the manner described below, to give an organic photoreceptor.

—Formation of Undercoat Layer—

An undercoat layer having a thickness of 1.0 μm is formed by applying a solution containing 20 parts by weight of a zirconium compound (trade name: Organotics ZC540, manufactured by Matsumoto Chemical Industry Co., Ltd.), 2.5 parts by weight of a silane compound (trade name: A1100, manufactured by Nippon Unicar Co., Ltd.), and 10 parts by weight of a polyvinylbutyral resin (trade name: S-LEC BM-S, manufactured by Sekisui Chemical Co., Ltd.) stirred in 45 parts by weight of butanol on an Al substrate surface having an external diameter of 84 mm and drying the coated film under heat at 150° C. for 10 minutes.

—Formation of Charge-Generating Layer—

Then, a mixture of 1 part by weight of chlorogallium phthalocyanine as a charge-generating substance, 1 part by weight of polyvinylbutyral (trade name: S-LEC BM-S, manufactured by Sekisui Chemical Co., Ltd.) and 100 parts by weight of n-butyl acetate is dispersed with glass beads in a paint shaker for 1 hour, to give a dispersion for forming a charge-generating layer. A charge-generating layer having a thickness of 0.15 μm is formed by coating the dispersion on the undercoat layer by a dip-coating method and drying the coated film at 100° C. for 10 minutes.

—Formation of Charge-Transporting Layer—

Then, 2 parts by weight of the compound represented by the following formula (1) and 3 parts by weight of the polymer compound represented by the following formula (2) (weight-average molecular weight: 39,000) are dissolved in 20 parts by weight of chlorobenzene, to give a charge-transporting layer-coating solution. A charge-transporting layer having a thickness of 20 μm is formed by applying the coating solution on the charge-generating layer by dip-coating method and drying the coated film at 110° C. for 40 minutes heating, to give an organic photoreceptor having an undercoat layer, a charge-generating layer and a charge-transporting layer formed on an Al substrate in this order (hereinafter, referred to as "non-coated photoreceptor").

Structural formula (1)

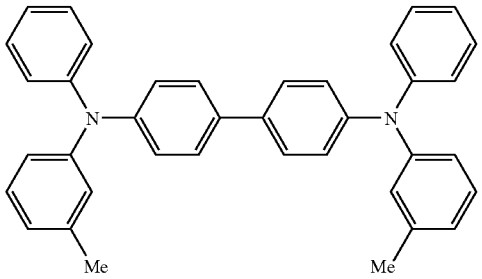

Structural formula (2)

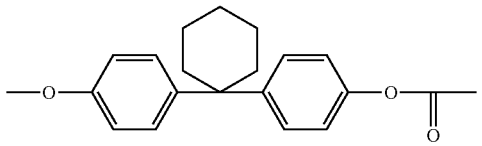

—Formation of Intermediate Layer—

Five parts by weight of the compound represented by the following formula (3), 7 parts by weight of a resol phenol resin (PL-4852, manufactured by Gunei Chemicla Industry), 0.03 part by weight of methylphenylpolysiloxane and 20 parts by weight of isopropanol are mixed and solubilized, to give an intermediate layer-coating solution. A surface-coated photoreceptor having an intermediate layer of phenol resin and having a thickness of 3 μm is formed by applying the coating solution on the charge-transporting layer of the non-coated photoreceptor by dip coating and drying the coated film at 130° C. for 40 minutes.

Structural formula (3)

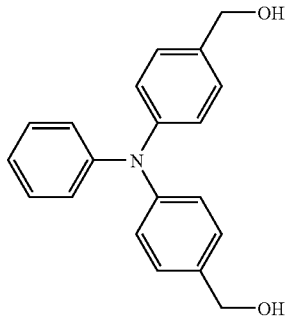

—Formation of Surface Layer—

A surface layer is formed on the surface of the photoreceptor having the intermediate layer (hereinafter, referred to as an "intermediate layer-carrying photoreceptor") in a film-forming apparatus in the configuration shown in FIG. 4.

First, the intermediate layer-carrying photoreceptor is placed on a substrate holder 13 in the film-forming chamber 10 of film-forming apparatus, and the film-forming chamber 10 is evacuated through the exhaust vent 11 to a pressure of approximately 0.1 Pa. Then, a mixed gas of nitrogen gas and $H_2$ gas at a ratio of 1:2 is supplied through a gas-supplying tube 20 into a high-frequency discharge tube unit 21 containing an electrode 19 having a diameter of 50 mm at a flow rate of 300 sccm (nitrogen gas: 100 sccm, hydrogen gas: 200 sccm), and a radiofrequency wave of 13.56 MHz is discharged from the flat plate electrode 19 by a high-frequency power supply unit 18 and a matching circuit (not shown in FIG. 4) at an output of 100 W, while the discharge is matched with a tuner. The reflected wave is 0 W then.

Subsequently, a trimethylgallium gas-containing mixed gas containing hydrogen as the carrier gas is supplied through the gas inlet 15 from a shower nozzle 16 to the plasma diffusion unit 17 in the film-forming chamber 10 at a trimethylgallium gas flow rate of 3 sccm. The reaction pressure in the film-forming chamber 10 then, as determined by a Baratron vacuum gauge (manufactured MKS Instrument, Inc), is 40 Pa.

In the state, a GaN film having a film thickness of 0.15 μm is formed on the intermediate layer-carrying photoreceptor while it is rotated at a speed of 2 rpm over a period of 60 minutes, to give an organic photoreceptor having a surface layer formed on the intermediate layer surface. The intermediate layer-carrying photoreceptor is not heat-treated during film formation. The color of a thermotape (TEMP-PLATE P/N101, manufactured by Wahl), which is previously attached to the surface of the intermediate layer-carrying photoreceptor placed under the condition same as that for film formation, is found to be 45° C. after film formation.

—Analysis and Evaluation of Surface Layer—

In forming a surface layer on the intermediate layer-carrying photoreceptor surface, the infrared ray absorption spectrum of the film formed on Si substrate is also obtained, showing that there are peaks corresponding to Ga—H, Ga—N and N—H bonds. The fact indicates that there are gallium, nitrogen and hydrogen contained in the surface layer. The Ga—N absorption peak has a full width at half maximum of 130 $cm^{-1}$.

The composition of the sample after XPS analysis is determined by Rutherford back-scattering, showing that there are Ga, N as well as oxygen (in an amount of 20 atom %) detected in the region within 10 nm from the surface and that the ratio of Ga to N is 0.45:0.55 in the region deeper than the region above.

In addition, the hydrogen content in film, as determined by HFS (hydrogen forward scattering), is 15 atom %, and there is a blurred ring in the diffraction image obtained by RHEED (reflection high-energy electron diffraction) measurement, indicating that the film are amorphous containing microcrystalline or microcrystalline having a particle diameter of approximately 50 angstroms.

The film immediately after formation on the Si substrate has solubilization spots when immersed in water, however the film left in normal-temperature and normal-humidity environment for a day is resistant to solubilization even when immersed in water and has no damage after abrasion with a stainless steel. The analysis and evaluation results show that the surface layer formed is a microcrystalline amorphous film in a composition containing hydrogen, nitrogen, gallium as well as oxygen, in which the oxygen atom concentration is highest in the outmost layer in the surface-layer thickness direction and declines gradually in the direction of the charge-transporting layer side.

—Evaluation—

Then, the electrophotographic characteristics of the organic photoreceptor having the surface layer are evaluated immediately after film formation. First, the residual electric potential on the of surface of the non-coated photoreceptors described above before and after the intermediate layer and the surface layer are formed is determined by scanning the surface thereof after irradiating an irradiation light (light source: semiconductor laser, wavelength: 780 nm, output 5 mW) on the surface of the photoreceptor rotating at a frequency of 40 rpm as it is charged by a Scorotron charger at −700 V. As a result, the residual electric potential of the non-coated photoreceptor is −20 V, while that of the organic photoreceptor having a surface layer is −25 V or less and independent of temperature or humidity at a favorable level.

In addition, the influence on sensitivity is evaluated over the entire light-source wavelength of from the infrared to visible region, showing that there is almost no difference between the non-coated photoreceptor and the photoreceptor having an intermediate layer and a surface layer, indicating that there is no deterioration in sensitivity by the intermediate and surface layers formed.

In addition, a peel test, i.e., removal of an adhesive tape bonded, on the surface of the photoreceptor having an intermediate layer and a surface layer results in completely no separation of the surface layer, showing that the adhesiveness is favorable.

Then, 20,000 sheets of paper are printed continuously under high-temperature and high-humidity environment (28° C., 80%), while the photoreceptor having an intermediate layer and a surface layer is installed in DocuCentre Color 500 manufactured by Fuji Xerox Co., Ltd. The image quality is evaluated several hours after film formation, showing that the image density is sufficiently favorable. For reference, a similar image is also formed, as the non-coated photoreceptor is installed in the DocuCentre Color 500.

As a result, a definite image having a resolution of 10 line/mm without image blurring in the dotted area is obtained, similarly to the initial print-test image formed by using the non-coated photoreceptor, both in the early phase of and after the print test. Visual observation of the photoreceptor surface after the print test shows no generation of damage or deposition of discharge products. The surface, as evaluated by a qualitative test of abrading with a paper towel, is superior in lubricity and lower in friction. In contrast, in the non-coated photoreceptor, the photoreceptor surface has scratches after the print test and is abraded to a thickness of 0.6 μm.

The results above reveal that the photoreceptor having an intermediate layer and a surface layer is improved in durability and also favorable in sensitivity and image quality such as image blurring at a level practically without problem.

Example 2

An organic photoreceptor having an intermediate layer similar to that in Example 1 is prepared; the photoreceptor is placed on a substrate holder 13 in a film-forming chamber 10 of film-forming apparatus, similarly to Example 1; and the film-forming chamber 10 is evacuated through an exhaust vent 11 to a pressure of approximately 0.1 Pa.

Then, a surface layer is formed on the surface of the intermediate layer-carrying photoreceptor. A mixed gas of nitrogen gas and $H_2$ gas at a ratio of 1:2 is supplied thought a gas-supplying tube 20 into a high-frequency discharge tube unit 21 containing an electrode 19 having a diameter of 50 mm at a flow rate of 300 sccm (nitrogen gas: 100 sccm, hydrogen gas: 200 sccm); a mixed gas of oxygen diluted with helium at a ratio of 100:1 is supplied through the gas-supplying tube 20 at a flow rate of 60 sccm; and a radiofrequency wave of 13.56 MHz is discharged from the flat plate electrode 19 by a high-frequency power supply unit 18 and a matching circuit (not shown in FIG. 4) at an output of 100 W, while the discharge is matched with a tuner. The reflected wave is 0 W then.

Subsequently, a trimethylgallium gas-containing mixed gas containing hydrogen as the carrier gas is supplied through the gas inlet 15 from a shower nozzle 16 to the plasma diffusion unit 17 in the film-forming chamber 10 at a trimethylgallium gas flow rate of 3 sccm. The reaction pressure in the film-forming chamber 10 then, as determined by a Baratron vacuum gauge (manufactured by MKS Instrument, Inc.), is 40 Pa.

In the state, a GaON film having a thickness of 0.25 μm is formed on the photoreceptor while it is rotated at a speed of 2 rpm over a period of 90 minutes, to give an organic photoreceptor having a surface layer. The photoreceptor is not heat-treated during film formation. The color of a thermotape (TEMP-PLATE P/N101, manufactured by Wahl), which is previously attached to the surface of the photoreceptor placed under the condition same as that for film formation, is found to be 42° C. after film formation.

—Evaluation—

Then, the electrophotographic characteristics of the organic photoreceptor having an intermediate layer and a surface layer are evaluated immediately after film formation. First, the residual electric potential on the of surface of the non-coated photoreceptors described above before and after the intermediate layer and the surface layer are formed is determined by scanning the surface thereof after irradiating an irradiation light (light source: semiconductor laser, wavelength: 780 nm, output 5 mW) on the surface of the photoreceptor rotating at a frequency of 40 rpm as it is charged by a Scorotron charger at −700 V surface. As a result, the residual electric potential of the non-coated photoreceptor is −20 V, while that of the organic photoreceptor having a surface layer is −30 V or less and independent of temperature or humidity at a favorable level. The influence on sensitivity is evaluated over the entire light-source wavelength of from the infrared to visible region, showing that there is almost no difference between the non-coated photoreceptor and the photoreceptor having an intermediate layer and a surface layer, indicating that there is no deterioration in sensitivity by the intermediate and surface layers formed. In addition, a peel test, i.e., removal of an adhesive tape bonded, on the surface of the photoreceptor having an intermediate layer and a surface layer results in completely no separation of the surface layer, showing that the adhesiveness is favorable.

—Analysis and Evaluation of Surface Layer—

In forming a surface layer on the intermediate layer-carrying photoreceptor surface, the infrared ray absorption spectrum of the film formed on a Si substrate is also obtained, showing that there are peaks corresponding to Ga—H and Ga—O bonds. The fact indicates that there are gallium, oxygen and hydrogen contained in the surface layer. The Ga—N absorption peak had a full width at half maximum of 250 $cm^{-1}$.

The composition of the sample after XPS analysis is determined by Rutherford back-scattering, showing that there are Ga and oxygen detected at a ratio of approximately 2:3 and additionally nitrogen. The hydrogen content in film, as determined by HFS (hydrogen forward scattering), is 12 atom %, and there is a blurred ring in the diffraction image obtained by RHEED (reflection high-energy electron diffraction) measurement, indicating that the film are amorphous containing microcrystalline or microcrystalline having a particle diameter of approximately 50 angstroms.

The film immediately after formation on the Si substrate has 92° of a contact angle to water and leaves no damage after abrasion with a stainless steel. The analysis and evaluation results show that the surface layer formed is a microcrystalline amorphous film in a composition containing hydrogen, oxygen, gallium as well as nitrogen.

Then, 20,000 sheets of paper are printed continuously under high-temperature and high-humidity environment (28° C., 80%), while the photoreceptor having an intermediate layer and a surface layer is installed in DocuCentre Color 500 manufactured by Fuji Xerox Co., Ltd. The image quality is evaluated several hours after film formation, showing that the image density is sufficiently favorable. For reference, a similar image is also formed, as the non-coated photoreceptor is installed in the DocuCentre Color 500.

As a result, a definite image having a resolution of 10 line/mm is obtained without image blurring in the dotted area, similarly to the initial print-test image formed by using the non-coated photoreceptor, both in the early phase of and after the print test. Visual observation of the photoreceptor surface after the print test shows no generation of scratch and the abrasion as determined by thickness measurement is 0 μm. There is no deposition of discharge products confirmed. The surface, as evaluated by a qualitative test of abrading with a paper towel, is superior in lubricity and lower in friction. In contrast, in the non-coated photoreceptor, the photoreceptor surface has scratches after the print test and is abraded to a thickness of 0.6 μm.

The results above reveal that the photoreceptor having an intermediate layer and a surface layer is improved in durability and also favorable in sensitivity and image quality such as image blurring at a level practically without problem.

Example 3

First, an organic photoreceptor (non-coated photoreceptor) having an undercoat layer, a charge-generating layer, and a charge-transporting layer formed on an Al substrate in this order is prepared in a similar manner to Example 1.

—Formation of Intermediate Layer—

An intermediate layer is formed on the non-coated photoreceptor surface in a film-forming apparatus in the configuration shown in FIG. 4.

First, the non-coated photoreceptor is placed on a substrate holder 13 in a film-forming chamber 10 of film-forming apparatus; the film-forming chamber 10 is evacuated through the exhaust vent 11 at the pressure of up to approximately 0.1 Pa. Then, a mixed gas of nitrogen gas and $H_2$ gas at a ratio of 1:2 is supplied thought a gas-supplying tube 20 into a high-frequency discharge tube unit 21 containing an electrode 19 having a diameter of 50 mm at a flow rate of 300 sccm (nitrogen gas: 100 sccm, hydrogen gas: 200 sccm); and a radiofrequency wave of 13.56 MHz is discharged from the flat plate electrode 19 by a high-frequency power supply unit 18 and a matching circuit (not shown in FIG. 4) at an output of 100 W, while the discharge is matched with a tuner. The reflected wave is 0 W then.

Subsequently, a trimethylaluminum gas-containing mixed gas containing hydrogen as the carrier gas is supplied through the gas inlet 15 from a shower nozzle 16 to the plasma diffusion unit 17 in the film-forming chamber 10 at a trimethylaluminum gas flow rate of 3 sccm. The reaction pressure in the film-forming chamber 10 then, as determined by a Baratron vacuum gauge (manufactured by MKS Instrument, Inc.), is 40 Pa.

In the state, an AlN film having a film thickness of 0.15 μm is formed on the non-coated photoreceptor while it is rotated at a speed of 10 rpm over a period of 60 minutes, to give an organic photoreceptor having a surface layer on the charge-transporting layer surface.

—Formation of Surface Layer—

A surface layer is formed on the surface of the organic photoreceptor having an intermediate layer in a similar manner to Example 2 above.

—Analysis and Evaluation of Intermediate Layer and Surface Layer—

A film similar to the intermediate layer is formed on the Si substrate under the condition identical with that for formation of the surface layer in Example 1; infrared ray absorption spectrum measurement of the film shows peaks corresponding to Al—H, Al—N and N—H bonds. The results show that the intermediate layer contains Al, nitrogen and hydrogen.

—Evaluation—

Then, the electrophotographic characteristics of the organic photoreceptor having the surface layer are evaluated. First, the residual electric potential on the of surface of the non-coated photoreceptors described above before and after the intermediate layer and the surface layer are formed is determined by scanning the surface thereof after irradiating an irradiation light (light source: semiconductor laser, wavelength: 780 nm, output 5 mW) on the surface of the photoreceptor rotating at a frequency of 40 rpm as it is charged by a Scorotron charger at −700 V. As a result, the residual electric potential of the non-coated photoreceptor is −20 V, while that of the organic photoreceptor having a surface layer is −50 V or less and independent of temperature or humidity at a favorable level. The influence on sensitivity is evaluated over the entire light-source wavelength of from the infrared to visible region, showing that there is almost no difference between the non-coated photoreceptor and the photoreceptor having an intermediate layer and a surface layer, indicating that there is no deterioration in sensitivity by the intermediate and surface layers formed. In addition, a peel test, i.e., removal of an adhesive tape bonded, on the surface of the photoreceptor having an intermediate layer and a surface layer results in completely no separation of the surface layer, showing that the adhesiveness is favorable.

Then, 20,000 sheets of paper are printed continuously under high-temperature and high-humidity environment (28° C., 80%), while the photoreceptor having an intermediate layer and a surface layer is installed in DocuCentre Color 500 manufactured by Fuji Xerox Co., Ltd. For reference in image quality evaluation, a similar image is also formed, as the non-coated photoreceptor is installed in the DocuCentre Color 500.

As a result, at next day of the film formation, a definite image having a resolution of 10 line/mm is obtained without image blurring in the dotted area is obtained, similarly to the initial print-test image formed by using the non-coated photoreceptor, both in the early phase of and after the print test. Visual observation of the photoreceptor surface after the print test shows no generation of damage and there is no deposition of discharge products confirmed. The surface, as evaluated by a qualitative test of abrading with a paper towel, is superior in lubricity and lower in friction. In contrast, in the non-coated photoreceptor, the photoreceptor surface has scratches after the print test and is abraded to a thickness of 0.6 μm.

The results above reveal that the photoreceptor having an intermediate layer and a surface layer is improved in durability and also favorable in sensitivity and image quality such as image blurring at a level practically without problem.

Example 4

Formation of Intermediate Layer

A non-coated photoreceptor similar to that in Example 1 is prepared, and an intermediate layer is formed on the surface in a film-forming apparatus in the configuration shown in FIG. 4.

First, the non-coated photoreceptor is placed on a substrate holder 13 in a film-forming chamber 10 of film-forming apparatus, and the film-forming chamber 10 is evacuated through the exhaust vent 11 to a pressure of approximately 0.1 Pa. Then, a mixed gas of nitrogen gas, $H_2$ gas, and oxygen gas at a ratio of 1:2:0.001 is supplied thought a gas-supplying tube 20 into a high-frequency discharge tube unit 21 containing an electrode 19 having a diameter of 50 mm at a flow rate of 300 sccm (nitrogen gas: 100 sccm, hydrogen gas: 200 sccm, oxygen gas: 0.1 sccm); and a radiofrequency wave of 13.56 MHz is discharged from the flat plate electrode 19 by a high-frequency power supply unit 18 and a matching circuit (not shown in FIG. 4) at an output of 100 W, while the discharge is matched with a tuner. The reflected wave is 0 W then.

Then, a mixed gas of nitrogen gas and $H_2$ gas at a ratio of 1:2 is supplied thought a gas-supplying tube 20 into a high-frequency discharge tube unit 21 containing an electrode 19 having a diameter of 50 mm at a flow rate of 300 sccm (nitrogen gas: 100 sccm, hydrogen gas: 200 sccm); a mixed gas containing oxygen diluted with helium at a ratio of 100:1 is supplied through the gas-supplying tube 20 additionally at a flow rate of 5 sccm; and a radiofrequency wave of 13.56 MHz is discharged from the flat plate electrode 19 by a high-frequency power supply unit 18 and a matching circuit (not shown in FIG. 4) at an output of 100 W, while the discharge is matched with a tuner. The reflected wave is 0 W then.

Subsequently, a trimethylaluminum gas-containing mixed gas containing hydrogen as the carrier gas is supplied through the gas inlet 15 from a shower nozzle 16 to the plasma diffusion unit 17 in the film-forming chamber 10 at a trimethylaluminum gas flow rate of 3 sccm. The reaction pressure in the film-forming chamber 10 then, as determined by a Baratron vacuum gauge (manufactured by MKS Instrument, Inc.), is 40 Pa.

In the state, an AlON film having a thickness of 0.15 μm is formed on the photoreceptor while it is rotated at a speed of 10 rpm over a period of 60 minutes, to give an organic photoreceptor having an intermediate layer. The photoreceptor is not heat-treated during film formation. The color of a thermotape (TEMP-PLATE P/N101, manufactured by Wahl), which is previously attached to the surface of the photoreceptor placed under the condition same as that for film formation, is found to be 42° C. after film formation.

Subsequently, a trimethylaluminum gas-containing mixed gas containing hydrogen as the carrier gas is supplied through the gas inlet 15 from a shower nozzle 16 to the plasma diffusion unit 17 in the film-forming chamber 10 at a trimethylaluminum gas flow rate of 3 sccm. The reaction pressure in the film-forming chamber 10 then, as determined by a Baratron vacuum gauge (manufactured by MKS Instrument, Inc.), is 40 Pa.

In the state, an AlON film having a thickness of 0.05 μm is formed on the non-coated photoreceptor while it is rotated at a speed of 2 rpm over a period of 30 minutes, to give an organic photoreceptor having a surface layer on the charge-transporting layer surface.

—Formation of Surface Layer—

A surface layer is formed on the surface of the organic photoreceptor having an intermediate layer in a similar manner to Example 2 above, to give organic photoreceptor having an intermediate layer and a surface layer.

—Analysis and Evaluation of Intermediate Layer and Surface Layer—

A film similar to the intermediate layer is formed on the Si substrate under the condition identical with that for formation of the surface layer in Example 1; and infrared ray absorption spectrum measurement of the film shows peaks corresponding to Al—O and Al—N bonds. There is no other characteristic peak. The results show that the intermediate layer contains Al, nitrogen and hydrogen.

—Evaluation—

Then, the electrophotographic characteristics of the organic photoreceptor having the surface layer are evaluated. First, the residual electric potential on the of surface of the non-coated photoreceptors described above before and after the intermediate layer and the surface layer are formed is determined by scanning the surface thereof after irradiating an irradiation light (light source: semiconductor laser, wavelength: 780 nm, output 5 mW) on the surface of the photoreceptor rotating at a frequency of 40 rpm as it is charged by a Scorotron charger at −700 V surface. As a result, the residual electric potential of the non-coated photoreceptor is −20 V, while that of the organic photoreceptor having a surface layer is −25 V or less and independent of temperature or humidity at a favorable level. The influence on sensitivity is evaluated over the entire light-source wavelength of from the infrared to visible region, showing that there is almost no difference between the non-coated photoreceptor and the photoreceptor having an intermediate layer and a surface layer, indicating that there is no deterioration in sensitivity by the intermediate and surface layers formed. In addition, a peel test, i.e., removal of an adhesive tape bonded, on the surface of the photoreceptor having an intermediate layer and a surface layer results in completely no separation of the surface layer, showing that the adhesiveness is favorable.

Then, 20,000 sheets of paper are printed continuously under high-temperature and high-humidity environment (28° C., 80%), while the photoreceptor having an intermediate layer and a surface layer is installed in DocuCentre Color 500 manufactured by Fuji Xerox Co., Ltd. For reference in image quality evaluation, a similar image is also formed, as the non-coated photoreceptor is installed in the DocuCentre Color 500.

As a result, at next day of the film formation, a definite image having a resolution of 10 line/mm is obtained without image blurring in the dotted area is obtained, similarly to the initial print-test image formed by using the non-coated photoreceptor, both in the early phase of and after the print test. Visual observation of the photoreceptor surface after the print test shows no generation of damage and layer thickness measurement and the abrasion is 0 μm. There is no deposition of discharge products confirmed. The surface, as evaluated by a qualitative test of abrading with a paper towel, is superior in lubricity and lower in friction. In contrast, in the non-coated photoreceptor, the photoreceptor surface has scratches after the print test and is abraded to a thickness of 0.3 μm.

The results above reveal that the photoreceptor having an intermediate layer and a surface layer is improved in durability and also favorable in sensitivity and image quality such as image blurring at a level practically without problem.

Example 5

Preparation of Electrophotographic Photoreceptor

First, an organic photoreceptor ("non-coated photoreceptor") having an undercoat layer, a charge-generating layer, and a charge-transporting layer formed on an Al substrate in this order is prepared in a similar manner to Example 1.

—Formation of Intermediate Layer—

An intermediate layer is formed on the non-coated photoreceptor surface in a film-forming apparatus in the configuration shown in FIG. 4.

First, the non-coated photoreceptor is placed on a substrate holder 13 in a film-forming chamber 10 of film-forming apparatus, and the film-forming chamber 10 is evacuated through the exhaust vent 11 to a pressure of approximately 0.1 Pa. Then, a mixed gas of nitrogen gas and $H_2$ gas at a ratio of 1:2 is supplied thought a gas-supplying tube 20 into a high-frequency discharge tube unit 21 containing an electrode 19 having a diameter of 50 mm at a flow rate of 300 sccm (nitrogen gas: 100 sccm, hydrogen gas: 200 sccm); and a radiofrequency wave of 13.56 MHz is discharged from the flat plate electrode 19 by a high-frequency power supply unit 18 and a matching circuit (not shown in FIG. 4) at an output of 100 W, while the discharge is matched with a tuner. The reflected wave is 0 W then.

Subsequently, a trimethylgallium gas-containing mixed gas containing hydrogen as the carrier gas at a pressure kept at 101 kPa at 0° C. is supplied through the gas inlet 15 from a shower nozzle 16 to the plasma diffusion unit 17 in the film-forming chamber 10 at a trimethylgallium gas flow rate of 3 sccm. The reaction pressure in the film-forming chamber 10 then, as determined by a Baratron vacuum gauge (manufactured by MKS Instrument, Inc.), is 40 Pa.

In the state, a GaN film having a thickness of 0.15 μm is formed on the non-coated photoreceptor while it is rotated at a speed of 10 rpm over a period of 60 minutes, to give an organic photoreceptor having a surface layer on the charge-transporting layer surface.

Infrared ray absorption spectrum measurement of the film formed on the Si substrate under a condition similar to that above shows that there are peaks corresponding to Ga—H, Ga—N, and N—H bonds. The results show that the intermediate layer contains gallium, nitrogen, hydrogen, and oxygen. The intensity ratio of the absorption peaks corresponding to N—H bond and Ga—H bond to that of the Ga—N bond are respectively 0.05 and 0.1, and the GaN absorption peak had a full width at half maximum of 200 $cm^{-1}$.

—Formation of Surface Layer—

After the intermediate layer is formed, a mixed gas of nitrogen, helium, hydrogen, and oxygen is supplied through a gas-supplying tube 20 into a high-frequency discharge tube unit 21 containing an electrode 19 having a diameter of 100 mm at a flow rate of approximately 450 sccm (nitrogen: 100 sccm, helium: 150 sccm, hydrogen: 200 sccm, oxygen: 0.3 sccm); and a radiofrequency wave of 13.56 MHz is discharged from the flat plate electrode 19 by a high-frequency power supply unit 18 and a matching circuit (not shown in FIG. 4) at an output of 100 W, while the discharge is matched with a tuner. The reflected wave is 0 W then.

Subsequently, a trimethylgallium gas-containing mixed gas containing hydrogen as the carrier gas at a pressure kept at 101 kPa at 0° C. is supplied through the gas inlet 15 from a shower nozzle 16 to the plasma diffusion unit 17 in the film-forming chamber 10 at a trimethylgallium gas flow rate of 3 sccm. The reaction pressure in the film-forming chamber 10 then, as determined by a Baratron vacuum gauge (manufactured by MKS Instrument, Inc.), is 40 Pa.

In this state, while non-coated photoreceptor having an intermediate layer formed is rotated at a frequency of 1 rpm for 60 minutes, a surface layer is formed on the intermediate layer, to give a photoreceptor (1) having a hydrogen-containing GaON film having a thickness of 0.25 μm as a surface layer. In forming the film, the non-coated photoreceptor is not heat-treated. The color of a thermotape (TEMP PLATE P/N101, manufactured by Wahl), which is previously attached to the surface of the photoreceptor placed before film formation to monitor the film forming temperature, is found to be 45° C. after film formation.

—Analysis and Evaluation of Surface Layer and Intermediate Layer—

Additionally in forming the surface layer, a sample film is formed on the intermediate layer on a Si substrate carrying the intermediate layer previously formed. The composition of the sample film is determined by Rutherford back scattering (RBS) and hydrogen forward scattering (HFS). The results show that the intermediate layer contains gallium, nitrogen and hydrogen respectively at 38 atom %, 40 atom %, and 22 atom %, while the surface layer contains gallium, nitrogen, oxygen and hydrogen respectively at 35 atom %, 18 atom %, 30 atom %, and 17 atom %. The oxygen is distributed over the entire surface layer, and carbon contained in the surface layer carbon is not more than the detection limit (0.5 atom %). There is a blurred ring in the halo pattern in the diffraction image obtained by RHEED (reflection high-energy electron diffraction) measurement, indicating that the film formed is amorphous microcrystalline.

—Surface property—

Hardness

The hardness is determined by visually observing the scratches on the surface of a sample film of approximately 10×10 mm in size formed on a Si crystal substrate used for composition analysis when it is abraded under light load with the vertex of a Si crystal of 5×10 mm in size, and evaluated according to the following criteria.

G1: There is no scratch.

G2: There are some scratches when the film surface is observed from a different angle after abrasion, but practically at the level without problem.

G3: There are scratches easily found on the film surface by visual observation.

Lubricity

The lubricity is determined by sensory evaluation of a lubricant degree when the photoreceptor surface before print test is rubbed with a clean tissue wiper (Bemcot, manufactured by Asahi Kasei Fibers Corporation). The evaluation criteria are as follows:

G1: No resistance between Bemcot (manufactured by Asahi Kasei Fibers Corporation) and photoreceptor surface, and favorable lubricity G2: Fundamentally favorable lubricity, although there is slight resistance between Bemcot (manufactured by Asahi Kasei Fibers Corporation) and photoreceptor surface.

G3: There is resistance between Bemcot (manufactured by Asahi Kasei Fibers Corporation) and photoreceptor surface, occasionally causing breakage of Bemcot.

Initial Water Resistance

The initial water resistance is determined by visual observation of the surface of a sample film formed on a Si substrate immediately after film formation after it is immersed in purified water for 10 seconds and withdrawn. The evaluation criteria are as follows:

G1: No change on film surface between before and after immersion in purified water G2: Some change, like staining, on film surface observed between before and after immersion in purified water.

G3: Distinct change on film surface between before and after immersion in purified water, and deliquescent film surface after immersion.

Initial Contact Angle

The initial contact angle is determined by measuring a drop of purified water placed on a sample film formed on a Si substrate immediately after film formation by using a contact angle meter CA-X roll-type (manufactured by Kyowa Interface Science Co., Ltd.) in an environment at 23° C. and 55% RH. Measurement is repeated thrice on different positions, and the average is used as the contact angle.

(Evaluation)

The electrophotographic characteristics of the organic photoreceptor having an intermediate layer and a surface layer are evaluated. First, the residual electric potential on the of surface of the non-coated photoreceptors described above before and after the intermediate layer and the surface layer are formed is determined by scanning the surface thereof after irradiating an irradiation light (light source: semiconductor laser, wavelength: 780 nm, output 5 mW) on the surface of the photoreceptor rotating at a frequency of 40 rpm as it is charged by a Scorotron charger at −700 V. As a result, the residual electric potential of the non-coated photoreceptor is −20 V, while that of the organic photoreceptor having a surface layer is −60 V or less and independent of temperature or humidity at a favorable level. The influence on sensitivity is evaluated over the entire light-source wavelength of from the infrared to visible region, showing that there is almost no difference between the non-coated photoreceptor and the photoreceptor having a surface layer, indicating that there is no deterioration in sensitivity by surface layer formed. In addition, a peel test, i.e., removal of an adhesive tape bonded, on the surface of the photoreceptor having a surface layer results in completely no separation of the surface layer, showing that the adhesiveness is favorable.

Then, 20,000 sheets of paper are printed continuously under high-temperature and high-humidity environment (28° C., 80%), while the photoreceptor having an intermediate layer and a surface layer is installed in DocuCentre Color 500 manufactured by Fuji Xerox Co., Ltd. For reference in image quality evaluation, a similar image is also formed, as the non-coated photoreceptor is installed in the DocuCentre Color 500.

—White Line—

The white line defects in the images before and after printing of 20,000 sheets of paper are compared. The evaluation criteria are as follows:

G1: Almost no white-line image defects

G3: Many white-line image defects seemingly due to the damage on photoreceptor

—Image Density—

After printing of 1,000 sheets of paper, a solid image at an area coverage of 100% is printed on 100 sheets of paper; when the image obtained is apparently lower in image density, it is judged that there is density decay.

—Image Blurring—

In evaluation of the image blurring, part of the photoreceptor surface is wiped with water for removal of water-soluble discharge products after printing of 20,000 sheets of paper.

Then, a half tone image (image density: 30%) is printed; it is judged whether the half tone images in the water-wiped region and non-water-wiped region of the photoreceptor surface have a difference in concentration detectable by visual observation; and an image showing distinct difference in density is regarded as a blurred image.

—Scratching—

The surface of a photoreceptor after print test is observed visually, and the scratching on the surface is examined. The results are summarized in Table 1.

Example 6

A photoreceptor (2) is prepared in a similar manner to Example 5, except that, in preparation of the electrophotographic photoreceptor of Example 5, the flow rate of the mixed gas of nitrogen, helium, hydrogen and oxygen supplied through the gas-supplying tube 20 for forming the surface layer is changed to approximately 450 sccm (nitrogen gas: 100 sccm, helium gas: 150 sccm, hydrogen: 200 sccm, oxygen: 0.6 sccm).

The photoreceptor is evaluated in a similar manner to Example 5, except that the photoreceptor (1) is replaced with photoreceptor (2).

The results including analysis of surface layer and others are summarized in Table 1.

Example 7

An intermediate layer is formed in a similar manner to Example 5, except that, in preparation of the electrophotographic photoreceptor of Example 5, a mixed gas of nitrogen, helium, hydrogen and oxygen for formation of the intermediate layer is first supplied through the gas-supplying tube 20 into the high-frequency discharge tube unit 21 at a flow rate of approximately 450 sccm (nitrogen gas: 100 sccm, helium gas: 150 sccm, hydrogen gas: 200 sccm, oxygen gas: 0.02 sccm) and a trimethylgallium gas-containing mixed gas using hydrogen gas as the carrier gas at 0° C. kept at a pressure of 101 kPa is supplied into the plasma diffusion unit 17 of film-forming chamber 10 at a flow rate of 3 sccm.

Then, a photoreceptor (3) is prepared by forming a surface layer thereon in a similar manner to Example 5, except that the mixed gas of nitrogen, helium, hydrogen and oxygen for formation of the surface layer is supplied through the gas-supplying tube 20 at a flow rate of approximately 450 sccm (nitrogen gas 100 sccm, helium gas 150 sccm, hydrogen 200 sccm, oxygen 0.8 sccm) and a trimethylgallium gas-containing mixed gas using hydrogen gas as the carrier gas at 0° C. kept at a pressure of 101 kPa is supplied into the plasma diffusion unit 17 of film-forming chamber 10 at a flow rate of 4 sccm.

The photoreceptor is evaluated in a similar manner to Example 5, except that the photoreceptor (1) is replaced with photoreceptor (3).

The results including analysis of surface layer and others are summarized in Table 1.

Example 8

An intermediate layer is formed in a similar manner to Example 5, except that, in preparation of the electrophotographic photoreceptor of Example 5, a mixed gas of nitrogen, helium, hydrogen and oxygen for formation of the intermediate layer is first supplied through the gas-supplying tube 20 into the high-frequency discharge tube unit 21 at a flow rate of approximately 450 sccm (nitrogen gas: 100 sccm, helium gas: 150 sccm, hydrogen gas: 200 sccm, oxygen gas: 0.03 sccm) and a trimethylgallium gas-containing mixed gas using hydrogen gas as the carrier gas at 0° C. kept at a pressure of 101 kPa is supplied into the plasma diffusion unit 17 of film-forming chamber 10 at a flow rate of 3 sccm.

Then, a photoreceptor (4) is prepared by forming a surface layer thereon in a similar manner to Example 5, except that the mixed gas of nitrogen, helium, hydrogen and oxygen for formation of the surface layer is supplied through the gas-supplying tube 20 at a flow rate of approximately 450 sccm (nitrogen gas 100 sccm, helium gas 150 sccm, hydrogen 200 sccm, oxygen 1.0 sccm) and a trimethylgallium gas-containing mixed gas using hydrogen gas as the carrier gas at 0° C. kept at a pressure of 101 kPa is supplied into the plasma diffusion unit 17 of film-forming chamber 10 at a flow rate of 4 sccm.

The photoreceptor is evaluated in a similar manner to Example 5, except that the photoreceptor (1) is replaced with photoreceptor (4).

The results including analysis of surface layer and others are summarized in Table 1.

Example 9

An intermediate layer is formed in a similar manner to Example 5, except that, in preparation of the electrophotographic photoreceptor of Example 7, a mixed gas of hydrogen, helium, and oxygen for formation of the intermediate layer is supplied through the gas-supplying tube 20 at a flow rate of approximately 400 sccm (hydrogen: 200 sccm, helium: 200 sccm, oxygen: 0.02 sccm). A photoreceptor (5) is prepared in a similar manner to Example 5, except that the amount of the mixed gas of hydrogen, helium and oxygen for formation of the surface layer supplied through the gas-supplying tube 20 is changed to approximately 400 sccm (hydrogen: 200 sccm, helium: 200, oxygen: 0.8 sccm).

The photoreceptor is evaluated in a similar manner to Example 5, except that the photoreceptor (1) is replaced with photoreceptor (5).

The results including analysis of surface layer and others are summarized in Table 1.

Example 10

A photoreceptor (6) is prepared in a similar manner to Example 5, except that, in preparation of the electrophotographic photoreceptor of Example 7, the amount of the mixed gas of hydrogen and nitrogen for formation of the surface layer supplied through the gas-supplying tube 20 is changed to approximately 350 sccm (hydrogen: 200 sccm, nitrogen: 150 sccm).

The photoreceptor is evaluated in a similar manner to Example 5, except that the photoreceptor (1) is replaced with photoreceptor (6).

The results including analysis of surface layer and others are summarized in Table 1.

Example 11

An intermediate layer is formed in a similar manner to Example 5, except that, in preparation of the electrophotographic photoreceptor of Example 1, the flow rate of the trimethylgallium mixed gas for formation of the intermediate layer is changed to 5 sccm. The layer thickness is 0.5 μm then.

Then, a photoreceptor (7) is prepared by forming a surface layer in a similar manner to Example 5, while the flow rate of the trimethylgallium mixed gas for formation of the surface layer is adjusted to 4 sccm. The thickness of the surface layer is 1.8 μm, and that of the surface and intermediate layers, 2.3 μm.

The photoreceptor is evaluated in a similar manner to Example 5, except that the photoreceptor (1) is replaced with photoreceptor (7).

The results including analysis of surface layer and others are summarized in Table 1.

Example 12

An intermediate layer is formed in a similar manner to Example 9, except that, in preparation of the electrophotographic photoreceptor of Example 9, the flow rate of the trimethylgallium mixed gas for formation of the intermediate layer is changed to 3 sccm. The layer thickness is 0.05 μm.

Then, a photoreceptor (8) is prepared by forming a surface layer in a similar manner to Example 9, while the flow rate of the trimethylgallium mixed gas for formation of the surface layer is adjusted to 3 sccm and the oxygen flow rate to 0.2 sccm. The thickness of the surface layer is 0.4 μm.

The photoreceptor is evaluated in a similar manner to Example 5, except that the photoreceptor (1) is replaced with photoreceptor (8).

The results including analysis of surface layer and others are summarized in Table 1.

Example 13

An intermediate layer is forming in a similar manner to Example 9, except that, in preparing the electrophotographic photoreceptor of Example 9, the flow rate of the trimethylgallium mixed gas for formation of intermediate layer is changed to 3 sccm. The layer thickness is 0.35 μm.

Then, a photoreceptor (9) is prepared by forming a surface layer in a similar manner to Example 9, while the flow rate of the trimethylgallium mixed gas for formation of the surface layer is adjusted to 3 sccm. The thickness of the surface layer is 0.05 μm.

The photoreceptor is evaluated in a similar manner to Example 5, except that the photoreceptor (1) is replaced with photoreceptor (9).

The results including analysis of surface layer and others are summarized in Table 1.

Comparative Example 1

Then, a photoreceptor (10) is prepared by forming a surface layer in a similar manner to Example 5, except that the intermediate layer of Example 5 is eliminated while the total layer thickness is kept the same, by changing the flow rate and the ratio of the trimethylgallium-containing gas, nitrogen gas, helium gas, hydrogen gas and oxygen gas.

The photoreceptor (10) is evaluated in a similar manner to Example 5. Results are summarized in Table 1.

Comparative Example 2

Then, a photoreceptor (11) is prepared by forming a surface layer in a similar manner to Example 5, except that the intermediate layer of Example 8 is eliminated while the total layer thickness is kept the same, by changing the flow rate and the ratio of the trimethylgallium-containing gas, nitrogen gas, helium gas, hydrogen gas and oxygen gas.

The photoreceptor (11) is evaluated in a similar manner to Example 5. Results are summarized in Table 1.

TABLE 1

| | | Example 5 | Example 6 | Example 7 | Example 8 | Example 9 | Example 10 |
|---|---|---|---|---|---|---|---|
| Photoreceptor No. | | (1) | (2) | (3) | (4) | (5) | (6) |
| Intermediate layer | Elements contained | Ga/N/H | Ga/N/H | Ga/N/O/H | Ga/N/O/H | Ga/O/H | Ga/N/O/H |
| | Composition ratio (atom %) | 38/40/22 | 38/40/22 | 38/35/5/22 | 38/33/7/22 | 38/49/13 | 38/35/5/22 |
| | Layer thickness (μm) | 0.15 | 0.15 | 0.15 | 0.20 | 0.20 | 0.15 |
| Surface layer | Elements contained | Ga/N/O/H | Ga/N/O/H | Ga/N/O/H | Ga/N/O/H | Ga/O/H | Ga/N/H |
| | Composition ratio (atom %) | 35/18/30/17 | 35/10/40/15 | 35/10/42/13 | 35/10/42/13 | 36/52/12 | 38/40/22 |
| | Layer thickness (μm) | 0.25 | 0.25 | 0.30 | 0.20 | 0.30 | 0.20 |
| Surface property | Hardness | G1 | G1 | G1 | G1 | G1 | G1 |
| | Lubricity | G2 | G2 | G1 | G1 | G1 | G1 |
| | Initial water resistance | G1 | G1 | G1 | G1 | G1 | G1 |
| | Initial contact angle (°) | 90 | 90 | 90 | 91 | 92 | 85 |
| Actual machine evaluation | White line generation | None | None | None | None | None | None |
| | Density decay (after printing on 1000 sheets) | None | None | None | None | None | Occur |
| | Image blurring (after printing on 20,000 sheets) | None | None | None | None | None | None |
| | Scratching (after printing on 20,000 sheets) | None | None | None | None | None | None |

| | | Example 11 | Example 12 | Example 13 | Comparative Example 1 | Comparative Example 2 |
|---|---|---|---|---|---|---|
| Photoreceptor No. | | (7) | (8) | (9) | (10) | (11) |
| Intermediate layer | Elements contained | Ga/N/H | Ga/O/H | Ga/O/H | — | — |
| | Composition ratio (atom %) | 38/42/20 | 38/49/13 | 38/49/13 | — | — |
| | Layer thickness (μm) | 0.50 | 0.05 | 0.35 | — | — |
| Surface layer | Elements contained | Ga/O/H | Ga/O/H | Ga/O/H | Ga/N/O/H | Ga/N/O/H |
| | Composition ratio (atom %) | 36/52/12 | 37/50/13 | 36/52/12 | 35/18/30/17 | 35/10/42/13 |
| | Layer thickness (μm) | 1.80 | 0.40 | 0.05 | 0.40 | 0.40 |
| Surface property | Hardness | G1 | G1 | G1 | G1 | G1 |
| | Lubricity | G1 | G1 | G1 | G2 | G1 |
| | Initial water resistance | G1 | G1 | G1 | G1 | G1 |
| | Initial contact angle (°) | 90 | 92 | 92 | 90 | 90 |
| Actual machine evaluation | White line generation | None | None | None | None | None |
| | Density decay (after printing on 1000 sheets) | None | None | None | Occur | Occur |

TABLE 1-continued

| | | | | | |
|---|---|---|---|---|---|
| Image blurring (after printing on 20,000 sheets) | None | None | None | None | None |
| Scratching (after printing on 20,000 sheets) | None | None | None | Slight scratching | Slight scratching |

As shown in Table 1, the photoreceptors having an intermediate layer in Examples do not cause image density decay after repetitive print output even in high-temperature and high-humidity environment compared with the photoreceptors having no intermediate layer in Comparative Examples.

What is claimed is:

1. An electrophotographic photoreceptor comprising a conductive substrate, and an organic photosensitive layer, an intermediate layer, and a surface layer formed on the conductive substrate in this order, and the surface layer containing a Group 13 element and at least one of nitrogen or oxygen.

2. The electrophotographic photoreceptor of claim 1, wherein the intermediate layer is a hardened organic resin layer.

3. The electrophotographic photoreceptor of claim 1, wherein the intermediate layer is a layer hardened by plasma.

4. The electrophotographic photoreceptor of claim 1, wherein the intermediate layer is a layer containing aluminum, and at least one of nitrogen or oxygen.

5. The electrophotographic photoreceptor of claim 1, wherein the Group 13 element contained in the surface layer is gallium.

6. The electrophotographic photoreceptor of claim 1, wherein both the intermediate layer and the surface layer contain a Group 13 element and at least one of nitrogen or oxygen, and at least one of the kind or the composition of the elements contained in the intermediate layer and the surface layer is different.

7. The electrophotographic photoreceptor of claim 1, wherein the total thickness of the surface and intermediate layers is at least 0.1 μm and less than 5 μm, and in the range of 0.5 to 10% with respect to the thickness of the photosensitive layer.

8. The electrophotographic photoreceptor of claim 1, wherein the surface layer contains hydrogen.

9. An image-forming apparatus comprising an electrophotographic photoreceptor comprising a conductive substrate, and an organic photosensitive layer, an intermediate layer, and a surface layer formed on the conductive substrate in this order, and the surface layer containing a Group 13 element and at least one of nitrogen or oxygen, a charging unit for charging the electrophotographic photoreceptor surface, an electrostatic latent image-forming unit for forming an electrostatic latent image on the charged electrophotographic photoreceptor, a developing unit for developing the electrostatic latent image into a toner image with a toner-containing developer, and a transfer unit for transferring the toner image onto a recording medium.

10. A process cartridge, integrally comprising an electrophotographic photoreceptor comprising a conductive substrate, and an organic photosensitive layer, an intermediate layer, and a surface layer formed on the conductive substrate in this order, and the surface layer containing a Group 13 element and at least one of nitrogen or oxygen, and at least one unit selected from the group consisting of a charging unit for charging the electrophotographic photoreceptor surface, a developing unit for forming a toner image on the electrophotographic photoreceptor surface with a toner-containing developer, and a cleaning unit for removing toner remaining on the electrophotographic photoreceptor surface.

11. The process cartridge of claim 10, wherein both the intermediate layer and the surface layer contain a Group 13 element and at least one of nitrogen or oxygen, and at least one of the kind or the composition of the elements contained in the intermediate layer and the surface layer is different.

12. The image-forming apparatus of claim 9, wherein both the intermediate layer and the surface layer contain a Group 13 element and at least one of nitrogen or oxygen, and at least one of the kind or the composition of the elements contained in the intermediate layer and the surface layer is different.

* * * * *